US009114548B2

(12) United States Patent
Otsuka

(10) Patent No.: US 9,114,548 B2
(45) Date of Patent: Aug. 25, 2015

(54) METHOD FOR FORMING A BEVEL CUT AT AN END OF A WOOD MEMBER

(75) Inventor: Toshiyuki Otsuka, Aichi (JP)

(73) Assignee: Meinan Machinery Works, Inc., Obu-shi (JP)

( * ) Notice: Subject to any disclaimer, the term of this patent is extended or adjusted under 35 U.S.C. 154(b) by 1125 days.

(21) Appl. No.: 13/064,934

(22) Filed: Apr. 27, 2011

(65) Prior Publication Data

US 2011/0203703 A1 Aug. 25, 2011

(30) Foreign Application Priority Data

Oct. 28, 2009 (JP) ..... 2009-247215

(51) Int. Cl.

| | |
|---|---|
| ***B27F 1/08*** | (2006.01) |
| ***B27F 1/12*** | (2006.01) |
| ***B27F 5/02*** | (2006.01) |
| ***B27D 1/10*** | (2006.01) |

(52) U.S. Cl.

CPC ... *B27F 1/12* (2013.01); *B27D 1/10* (2013.01); *B27F 1/08* (2013.01); *B27F 5/02* (2013.01)

(58) Field of Classification Search

CPC ..... B27F 1/02; B27F 1/04; B27F 1/06; B27F 1/08; B27F 1/16; B27F 5/00; B27F 5/02; B27F 5/026; B27F 5/06; B27F 5/08; B27F 1/12

USPC ..... 144/359, 363, 368, 369, 371, 377, 367, 144/374, 379

See application file for complete search history.

(56) References Cited

U.S. PATENT DOCUMENTS

| | | | | |
|---|---|---|---|---|
| 5,372,168 | A * | 12/1994 | Minami | 144/347 |
| 6,164,349 | A | 12/2000 | Hsieh | |
| 2011/0030303 | A1 | 2/2011 | Pervan et al. | |

FOREIGN PATENT DOCUMENTS

| | | |
|---|---|---|
| JP | 11-010605 A | 1/1999 |

OTHER PUBLICATIONS

European Search Report dated Oct. 4, 2011, issued for the corresponding European patent application No. 11163812.8.

* cited by examiner

*Primary Examiner* — Shelley Self
*Assistant Examiner* — Matthew G Katcoff
(74) *Attorney, Agent, or Firm* — Locke Lord LLP

(57) ABSTRACT

A method for forming a bevel cut at an end of a wood member is disclosed. A wood member is placed on a support table and a plurality of cutters mounted on and spaced along a shaft extending in parallel to the end of the wood member on the table is moved relative to the table in a direction inclined with respect to the wood member thereby to make a first cutting to form a plurality of bevel cuts. The support table is shifted in the direction parallel to the end of the wood member and a second cutting is made by the relative movement between the cutters and the table. During the first and second cutting, the wood member is pressed against the support table by a pressing member at a position adjacent to the end of the wood member and between any two adjacent cutters.

4 Claims, 25 Drawing Sheets

PRIOR ART

METHOD FOR FORMING A BEVEL CUT AT AN END OF A WOOD MEMBER

BACKGROUND OF THE INVENTION

The present invention relates to a method for forming a bevel cut at an end of a wood member.

Wood members including wood boards such as plywood, veneer laminated lumber (LVL), fiber board and also sheets such as veneer are joined together in an end-to-end manner in various joints using thermosetting or thermoplastic adhesive for producing a wood member with an increased length. For achieving the desired joint strength, the ends of a wood member are bevel cut so as to enlarge the area of the cut end surfaces to be coated with adhesive. Wood members are assembled with the opposing bevel cut ends coated with adhesive and lapped one on the other and the joining of the wood members is accomplished by allowing the adhesive to be set by heating or cooling depending on the type of the adhesive used.

For increasing the joint strength by further expanding the joint surface area, a wood member is formed at an end thereof with a series of groove-like V-shaped bevel cuts each extending from one surface to the other surface of the wood member and having two contiguous surfaces inclined so as to form a V-shape at any section across the bevel cuts, as shown in FIG. 24. As seen from the drawing, any two inclines surfaces of any two different adjacent groove-like bevel cuts form a ridge-like projections and two wood members are joined together with ridge projections fitted in the groove-like bevel cuts. The bevel cuts are formed in such a position that two wood members joined together at the two opposing ends thereof form a rectangular shape.

A method for forming such V-shaped bevel cuts will be explained in the following with reference to FIGS. 22 through 25.

FIG. 22 shows an example of a cutter assembly 11 having a plurality of cutters 3 mounted on a common rotatable shaft 2. Each cutter 3 has a plurality of cutting edges 3A arranged in the circumferential direction and any two adjacent cutting edges 3A in the circumferential direction of each cutter 3 are inclined in opposite direction with respect to an imaginary line extending parallel to the axis of the shaft 2 on which the cutters 3 are mounted. The cutters 3 are mounted on the shaft 2 in side-to-side contact with each other and disposed on the shaft 2 so that the cutting edges 3A of the respective cutters 3 are staggered in the circumferential direction as indicated by dashed-dotted spiral curved lines in FIG. 22 for the purpose of reducing the load acting on the cutter assembly 11 during cutting to form the bevel cuts.

FIG. 23 shows the movement of the cutter assembly 11 installed in a bevel cut forming apparatus with respect to a wood board 210 as a wood member to be cut. The cutters 3 rotating at a high speed in arrow direction are movable reciprocally along a path that is indicated by double-headed arrow between the raised standby position indicated by solid line and the lowered position indicated by dotted line. The path along which the cutter assembly 11 moves reciprocally is inclined at an angle (θ), for example, of about 10°.

As shown in FIG. 23, the wood board 210 is moved forward by a plurality of feeding rolls 220 (only one roll being shown in the drawing) to a position on a support table 215. Then, the rotating cutter assembly 11 is moved downward along the inclined path to its lowered position. As a result, a series of groove-like V-shaped bevel cuts 210A is formed at the leading end of the wood board 210 at an angle of θ with respect to the opposite surfaces of the wood board 210, as shown in FIG. 24.

Before the cutting is made, the wood board 210 is stopped at a such a position on the support table 215 that each resulting bevel cut 210A extends between the opposite top and bottom surfaces of the wood board 210.

The support table 215 on which the wood board 210 is supported is made of a material such as synthetic resin that is rigid and hard only to such an extent that the cutting edge 3A of a rotating cutter 3 is not broken by contact with the support table 215. Furthermore, as clearly shown from FIG. 23, the leading end of the support table 215 with respect to the wood board feeding direction indicated by arrow is formed with a cutout 215A that allows the cutting edges 3A of the rotating cutters 3 to move past support table 215 without mechanically interfering with the support table 215.

The cutout 215A of the support table 215 may be formed by firstly fixing a wood board such as 210 on the support table 215 and moving the rotating cutter assembly 11 downward along an inclined path that is located above and parallel to the aforementioned inclined path shown in FIG. 23 so that the cutters 3 form a small cutout at the end of the support table 215. Then, the cutter assembly 11 is moved again downward along an inclined path that is still lower than and parallel to the first said path to make a second cut so as to make the cutout deeper. Such cutting is repeated until the desired cutout 215A is formed at the end of the support table 215, as shown in FIG. 25. Thus, the wood board 210 is supported from the bottom in contact with the support table 215 except the area of the bottom just above the cutout 215A of the support table 215.

In preparing a second wood board that is to be joined end-to-end to the above wood board 210 already formed with the bevel cuts 210A, the second wood board is stopped at the same position on the support table 215 as in the case of the wood board 210 and then shifted in the direction that is perpendicular to the board feeding direction for a distance corresponding to half of the width of the cutter 3. With the second wood board thus set on the support table 210, the cutters 3 rotating in arrow direction are moved past the end of the second wood board thereby to form a series of similar bevel cuts. In joining the first and the second wood boards together, either one of the boards is inverted or turned upside down and the bevel cut end surfaces of the two boards are coated with adhesive and fitted together.

In the above method, however, if any part of the end of the wood board 210 has an upward bend or warp 210B as indicated by chain double-dashed line in FIG. 23, such bent part of the end is cut deeper than the other part of the end 210B, with the result that a void is formed in the joint formed by two opposing ends of two wood boards and the desired joint strength fails be to be achieved. A wood board made by joining two such boards may be broken at the joint when subjected to application of any force.

The present invention, which has been made in light of the above-identified problems, is directed to providing a method for forming a bevel cut at an end of a wood member which can solve the above-identified problems.

SUMMARY OF THE INVENTION

The method for forming a bevel cut at an end of a wood member according to the present invention is accomplished by performing a series of steps. The wood member may be, for example, of an rectangular shape having an end that extends straight. In accordance with an aspect of the present invention, the method includes firstly placing a wood member on a support table with the straight end of the wood member located adjacent to an end of the support table. The support table has formed previously at the end thereof with a cutout.

The method further includes pressing the wood member against the support table by a pressing member at a position adjacent to the straight end of the wood member and moving at least one of the support table and a plurality of cutters that are rotatable about a common axis of rotation extending parallel to the straight end of the wood member placed on the support table and each having a cutting width L1 as measured along the common axis, relative to each other in a direction that extends in a perpendicular relation to the straight end of the wood member placed on the support table and also is inclined with respect to opposite surfaces of the wood member placed on the support table, thereby to make a first cutting at the straight end of the wood member. The cutters are spaced along the common axis with a spaced distance mL1 between any two adjacent cutters, where m represents an integer that is one or more. The first cutting is performed with the wood member being pressed against the support table by a pressing member at a position between at least any selected two adjacent cutters.

The cutout of the of the support table is formed inclined substantially in the same direction of the relative movement between the support table and the cutters so that no interference occurs between the cutter and the support table during their relative movement.

After the first cutting is performed, the pressing of the wood member by the pressing member is released and at least one of the support table and the cutters is shifted relative to each other in a direction along the common axis of the cutters for a distance of nL1, where n represents an integer that is one or more. After such relative shifting movement between the support table and the cutters, the wood member is pressed against the support table by the pressing member that is then in pressing contact with cut surfaces formed by the first cutting. Then, at least one of the support table and the cutters is moved relative to each other in the shifted position of at least one of the support table and the cutters in the same direction as in the first cutting thereby to make a second cutting at the straight end of the wood member. The second cutting is performed with the wood member being pressed against the support table by the pressing member at a position between at least any selected two adjacent cutters. The second cutting is done at least once for one time of the first cutting. As a result of the first and the second cutting, a series of continuous bevel cuts each extending from one surface to the other of the wood member, having a width L1 along the straight end of the wood member and two contiguous surfaces inclined so as to form a V-shape at any section across the bevel cut is formed at said straight end of the wood member at an interval of L1.

The pressing member used for pressing the end of the wood member against the support table has a first surface that is pressingly contactable with flat surface of the wood member during the first cutting and a second surface that is pressingly contactable during the second cutting with the cut surfaces formed by the first cutting.

Features and advantages of the present invention will become more apparent to those skilled in the art from the following description of embodiments of the invention, which description is made with reference to the accompanying drawings, wherein:

DETAILED DESCRIPTION OF THE EMBODIMENTS

The following will describe the first embodiment of the method for forming a bevel cut at an end of a wood member according to the present invention by way of describing an apparatus used for practicing the method and the operation of the apparatus with reference to FIGS. 1 through 11. In the following description, a plywood board with a rectangular shape having a straight end and with a thickness of about 12 mm will be used as the wood member and such plywood board will be referred to hereinafter as "wood board."

Figure 2:
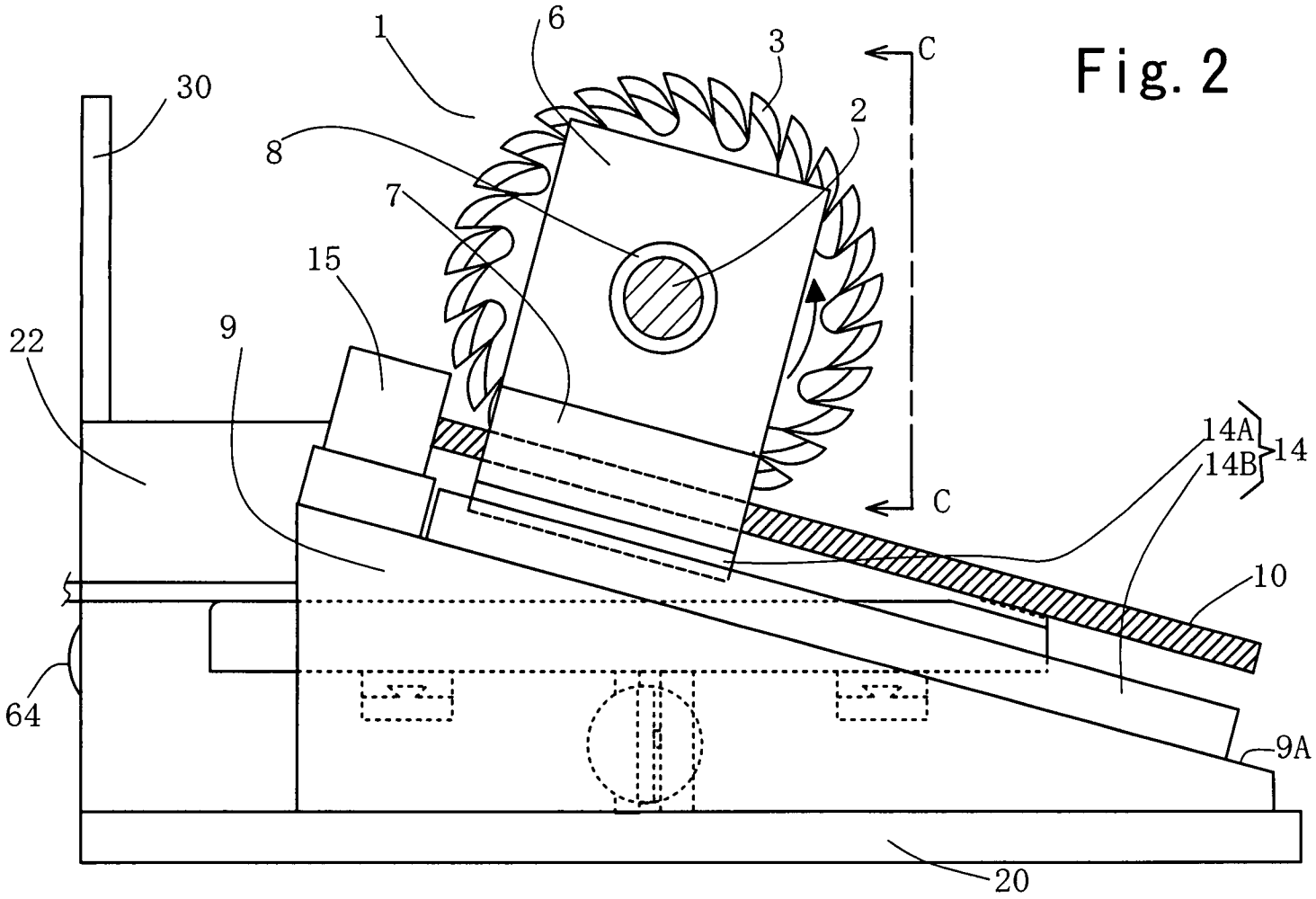
FIG. 2 is an enlarged fragmentary side view of the apparatus as seen in arrow direction A-A of FIG. 1.
Figure 3:
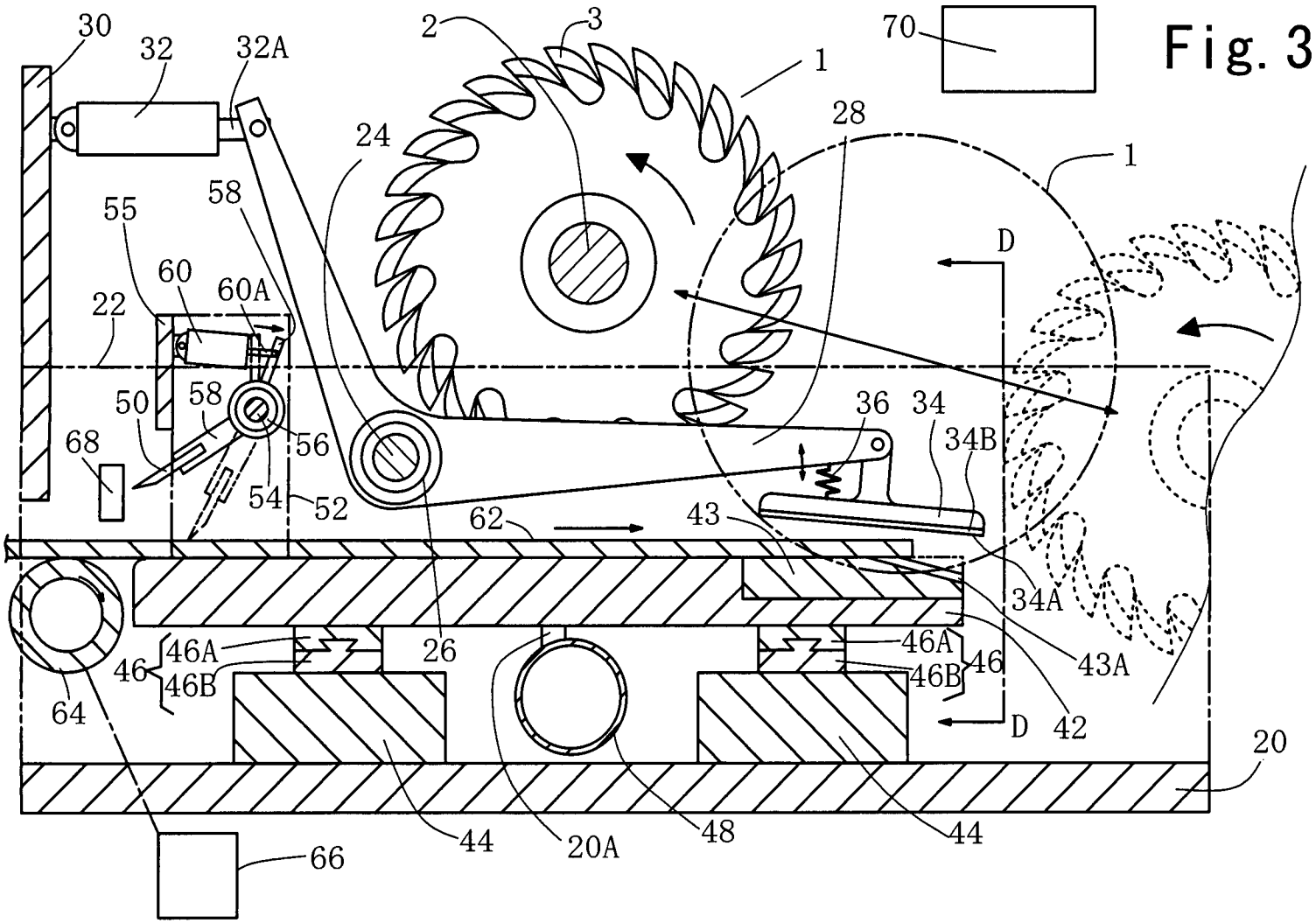
FIG. 3 is an enlarged fragmentary side view of the apparatus as seen in arrow direction B-B of FIG. 1.
Figure 4:
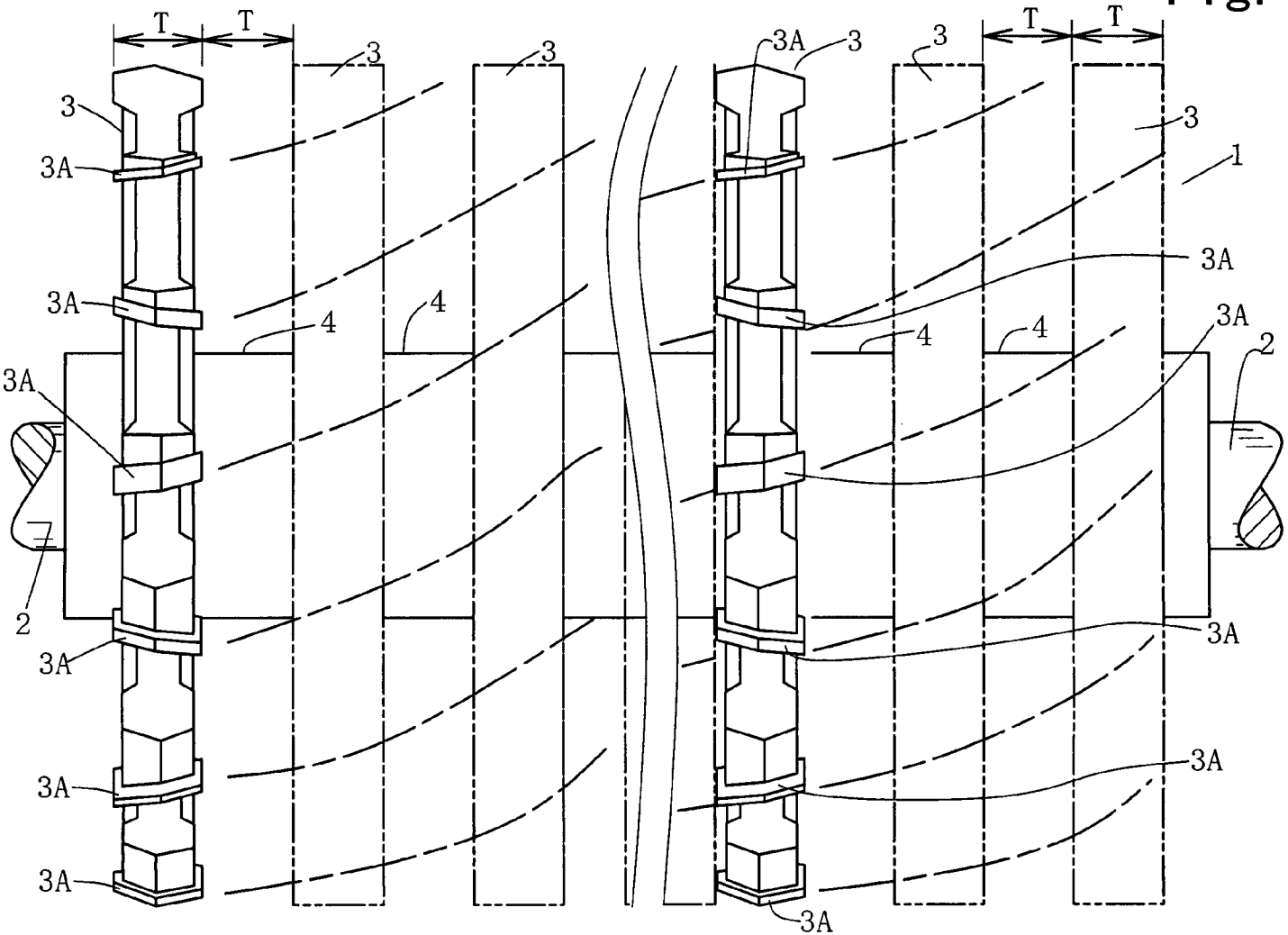
FIG. 4 is a enlarged fragmentary front view with an intermediate part omitted from the illustration, showing a cutter assembly of the apparatus as seen in arrow direction C-C of FIG. 2.
Figure 22:
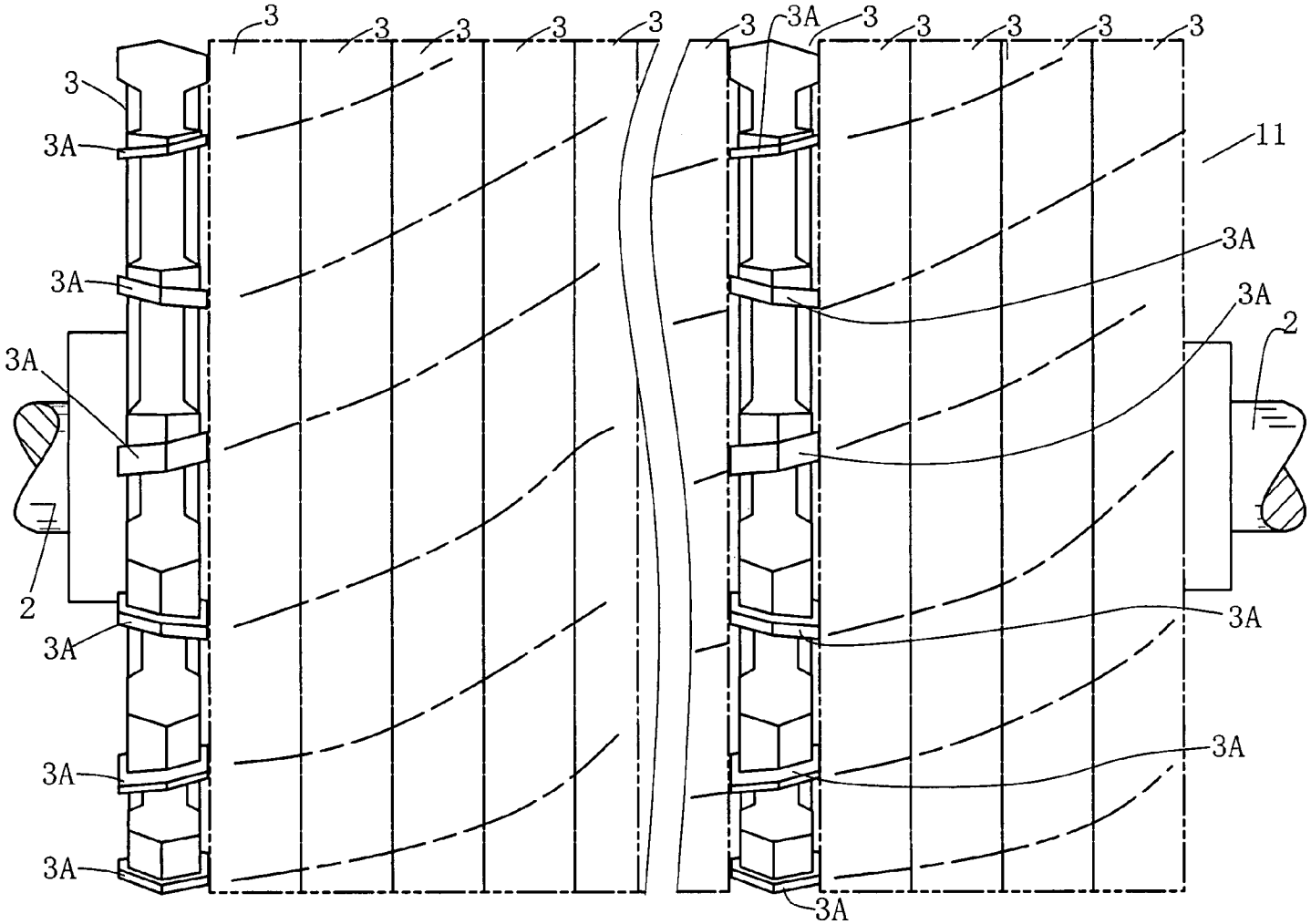
FIG. 22 is a front view with an intermediate part omitted from the illustration, showing a cutter assembly of a conventional bevel cut apparatus.
Figure 23:
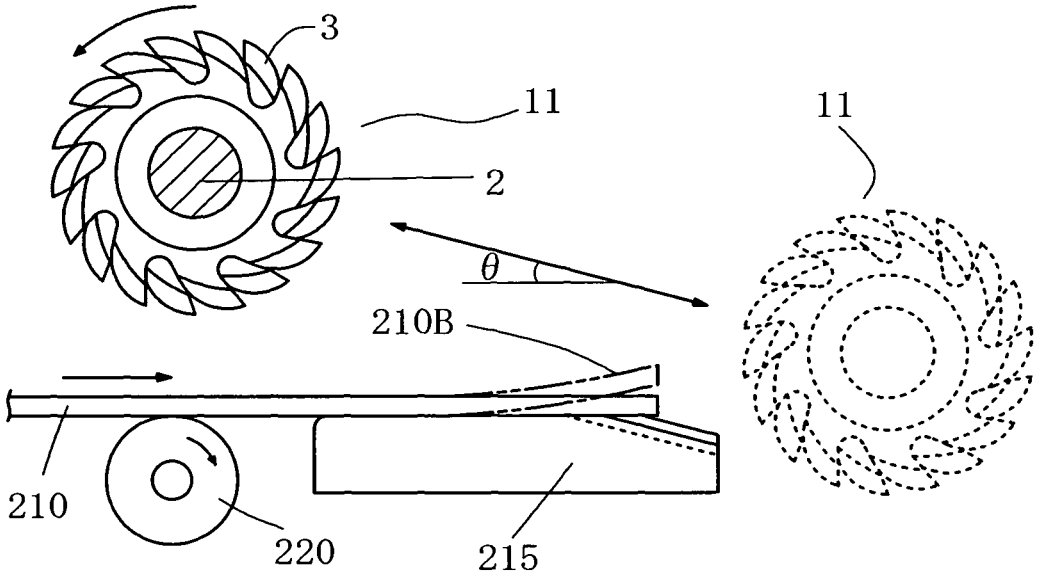
PRIOR ART Fig. 23
FIG. 23 is schematic side view showing a manner of forming bevel cuts in the apparatus of FIG. 22.
Figure 24:
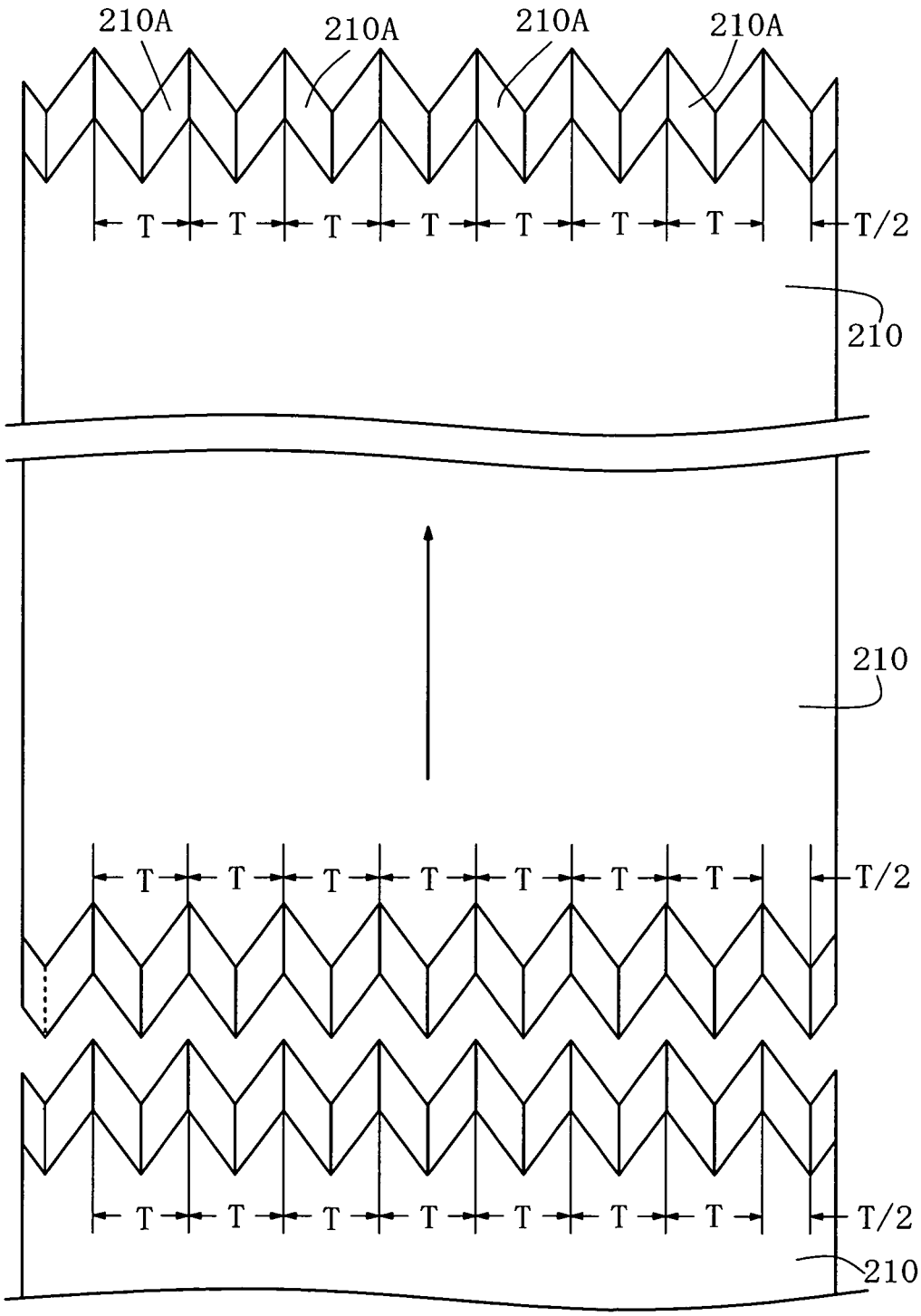
Fig. 24 PRIOR ART
FIG. 24 is a plan view showing a wood board formed with a plurality of bevel cuts.
Figure 25:
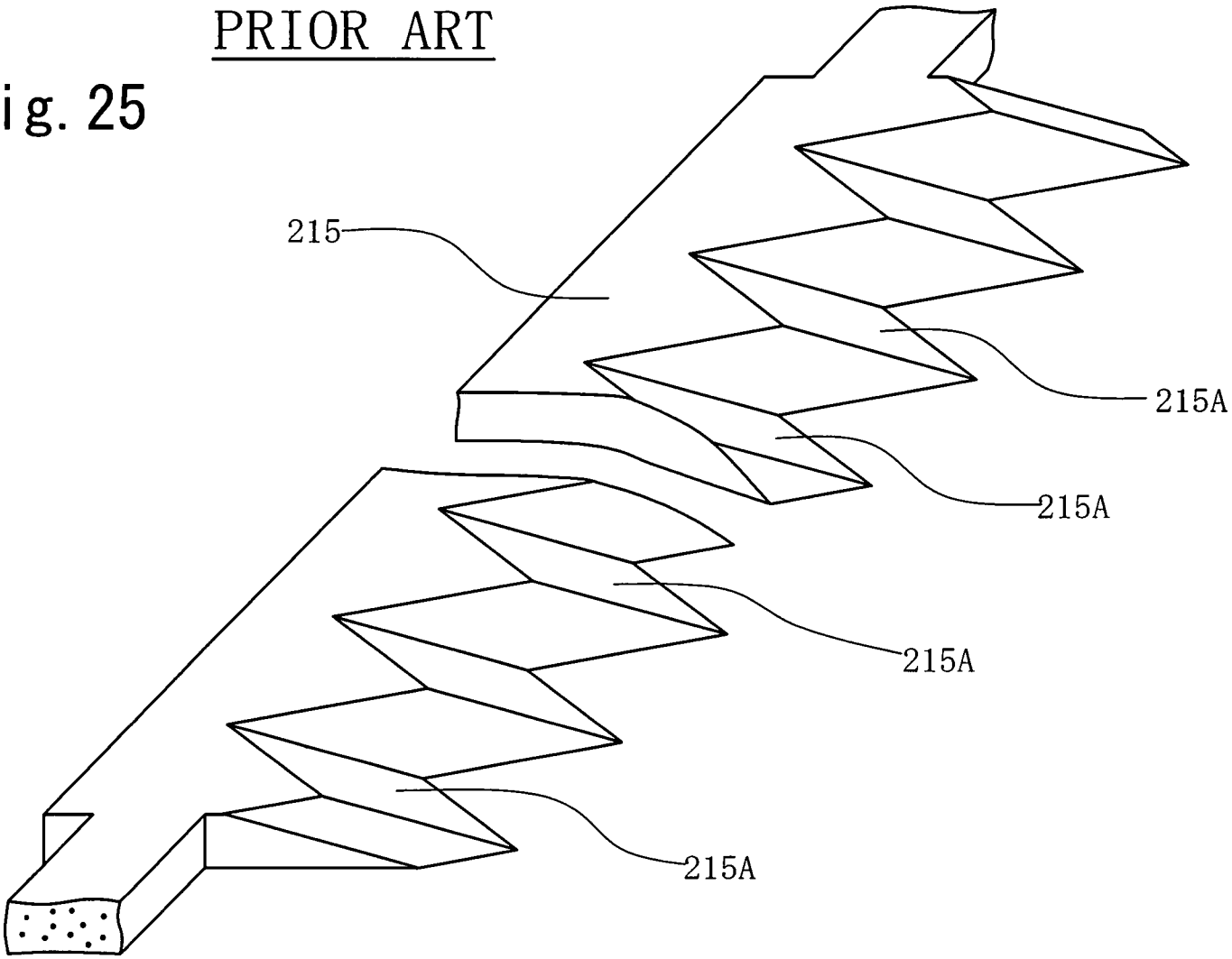
PRIOR ART Fig. 25
FIG. 25 is a fragmentary perspective view showing the end of a support table that is formed with a cutout.

Referring firstly to FIGS. 1 through 4, reference numeral 1 designates generally a cutter assembly of the apparatus. As shown in FIG. 4 in detail, the cutter assembly 1 includes a common drive shaft 2, a plurality of cutters 3 mounted on the common drive shaft 2 and each having a cutting width T of about 24 mm, and a plurality of spacers 4 each disposed between any two adjacent cutters 3 and having a width T of about 24 mm corresponding to the width T of the cutter 3. The cutters 3 and the spacers 4 are disposed alternately on the drive shaft 2, spanning a distance that is large enough to cover the entire width or the end of a wood board 62 to be formed with bevel cuts. As in the case of the cutters in FIG. 22, each cutter 3 has a plurality of cutting edges 3A arranged in the circumferential direction of the cutter 3 and any two adjacent cutting edges 3A in the circumferential direction are inclined in opposite directions so that a V-shaped groove-like bevel cut is formed by the cutting edges 3A of each cutter 3. The cutters 3 are disposed on the shaft 2 so that the cutting edges 3A of the respective cutters 3 are staggered in the circumferential direction as indicated by dashed-dotted spiral curved lines in FIG. 4, for reducing the load imposed on a servomotor 18 (FIG. 1) for driving the shaft 2 for the cutters 3.

For the sake of the description hereinafter, the direction in the apparatus that is parallel to the drive shaft 2 will be referred to as "first direction" and the direction that is perpendicular to the first direction will be referred to as "second direction," as indicated by double-headed arrows in FIG. 1.

Figure 1:
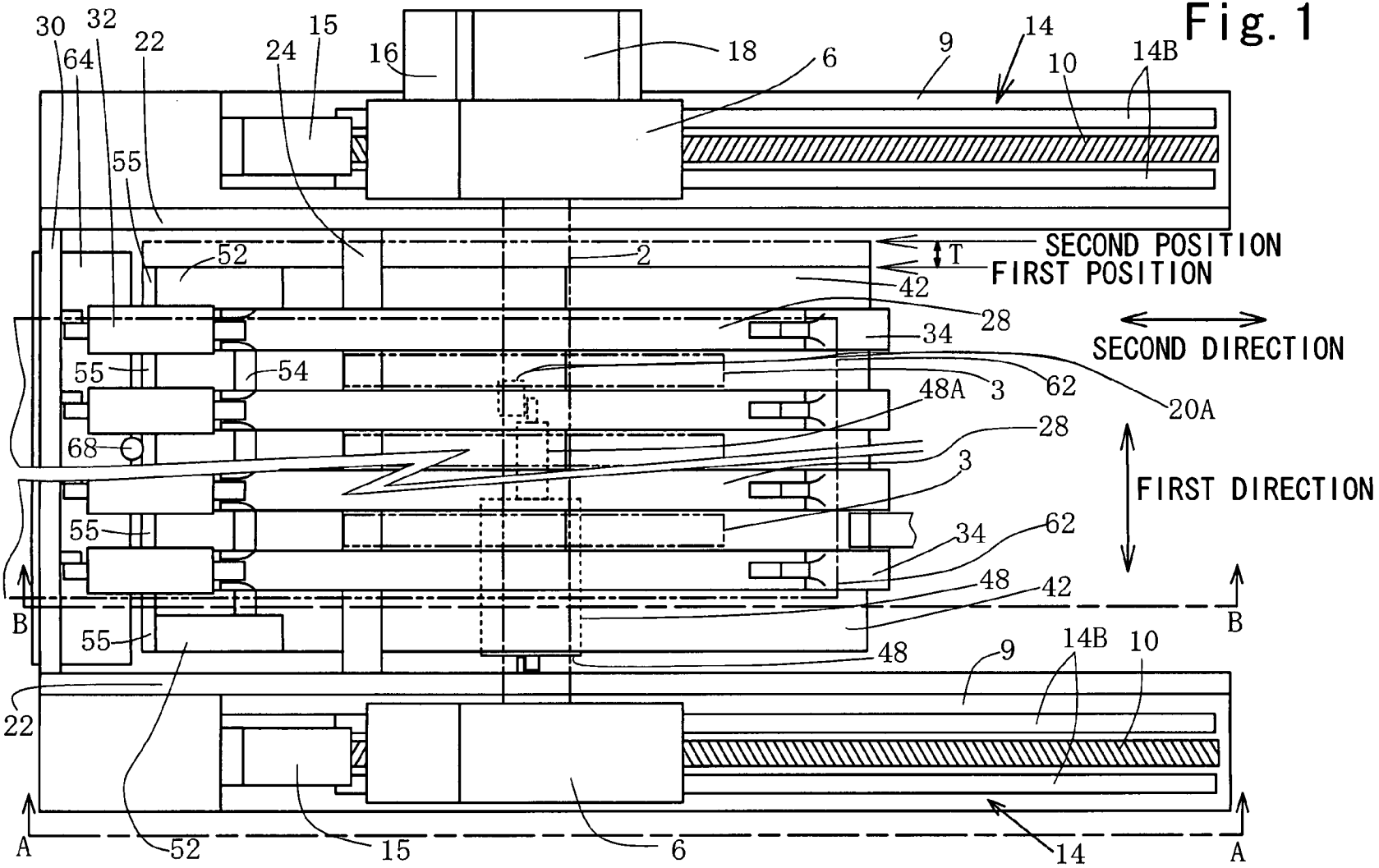
FIG. 1 is a plan view with an intermediate part omitted from the illustration, showing an example of an apparatus used for practicing a first embodiment of the method for forming a bevel cut at an end of a wood board as a wood member according to the present invention.

In FIGS. 1 and 2, reference numeral 6 designates a pair of support blocks and the above drive shaft 2 is rotatably supported at the opposite ends thereof by bearings 8 provided in the respective support blocks 6. Reference numeral 7 designates a pair of cutter carriage blocks 7 (only one block being shown in the drawing). Each carriage block 7 has formed therethrough an internally threaded hole (indicated by dotted lines) and a leadscrew 10 is engaged with the carriage block 7 by being inserted through the threaded hole. The aforementioned support blocks 6 are fixedly mounted at the bottom thereof to the respective cutter carriage blocks 7.

In FIGS. 2 and 3, reference numeral 20 designates a frame base of the apparatus and 9 a pair of parallel guide blocks (only one block being shown) fixedly mounted on the frame base 20 and each having an inclined top surface 9A. Further, reference numeral 14 designates a pair of linear bearings 14 (only one bearing being shown in FIG. 2) each including a stationary linear base 14B fixed to the top surface 9A of its corresponding guide block 9 and a slide 14A that is movable along the stationary linear base 14B. The paired inclined linear bearings 14 are disposed at an angle of about 10° with respect to the top surface of a support table 42 which will be described in detail in later part hereof. The aforementioned cutter carriage blocks 7 are fixedly mounted at the bottom thereof to the movable slides 14A of the respective linear bearings 14 so that the movement of the cutter carriage blocks 7 is guided linearly in an inclined direction by the linear bearings 14. That is, the paired support blocks 6 carrying the drive shaft 2 of the cutter assembly 1 and fixed to the cutter carriage blocks 7 are movable linearly along the inclined linear bearings 14.

Each leadscrew 10 is connected at one end thereof, i.e. the left upper end as seen in FIG. 2, to a servomotor 15 that is reversibly operable in response to control signals from a control unit 70 (FIG. 3) so that the paired leadscrews 10 are reversibly rotated synchronously. Rotating the leadscrews 10 in forward direction, the cutter assembly 1 is moved downward in an inclined direction along the liner bearings 14 from their retracted position indicated by solid line in FIGS. 2 and 3 to their lowered position indicated by dotted line in FIG. 3. Reversing the leadscrews 10 causes the cutter assembly 1 to move reversely or upwardly along the linear bearings 14.

The aforementioned servomotor 18 for rotating the drive shaft 2 for the cutters 3 is fixedly mounted on a support member 16 which is in turn fixed to a frame of the apparatus. The servomotor 18 is connected to one end of the drive shaft 2 and electrically connected to the control unit 70 to receive control signals therefrom. The servomotor 18 is normally at a stop, but activated in response to a signal from the control unit 70 to rotate in arrow direction as shown in FIG. 3 before the cutter assembly 1 begins to move downward from its retracted elevated position. It is so controlled that the servomotor 18 is stopped automatically when the cutter assembly 1 reaches its lowered position.

Figure 5:
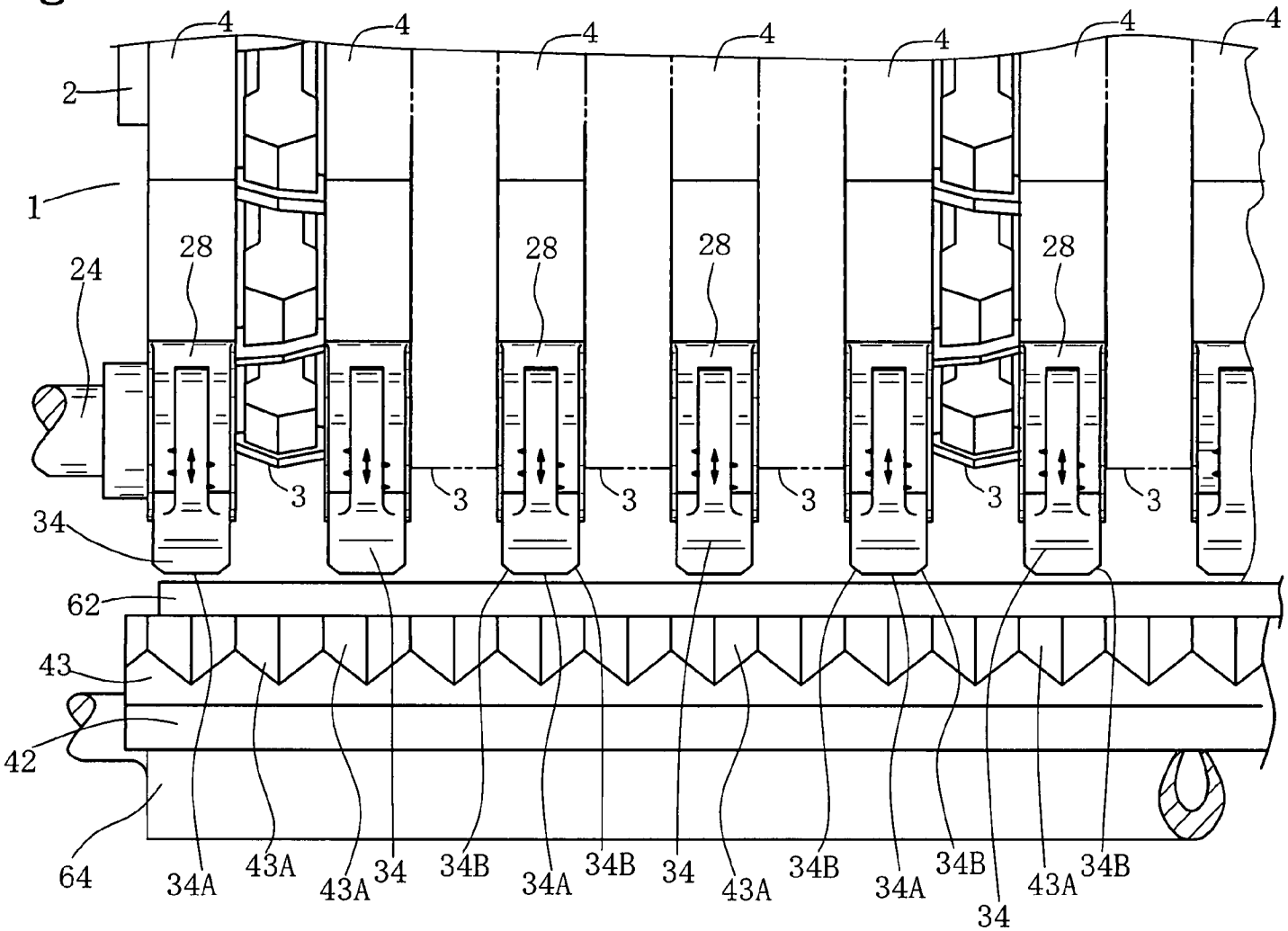
FIG. 5 is an enlarged fragmentary front view as seen in arrow direction D-D of FIG. 3, showing pressing arms and other elements the apparatus of FIG. 1.
Figure 6:
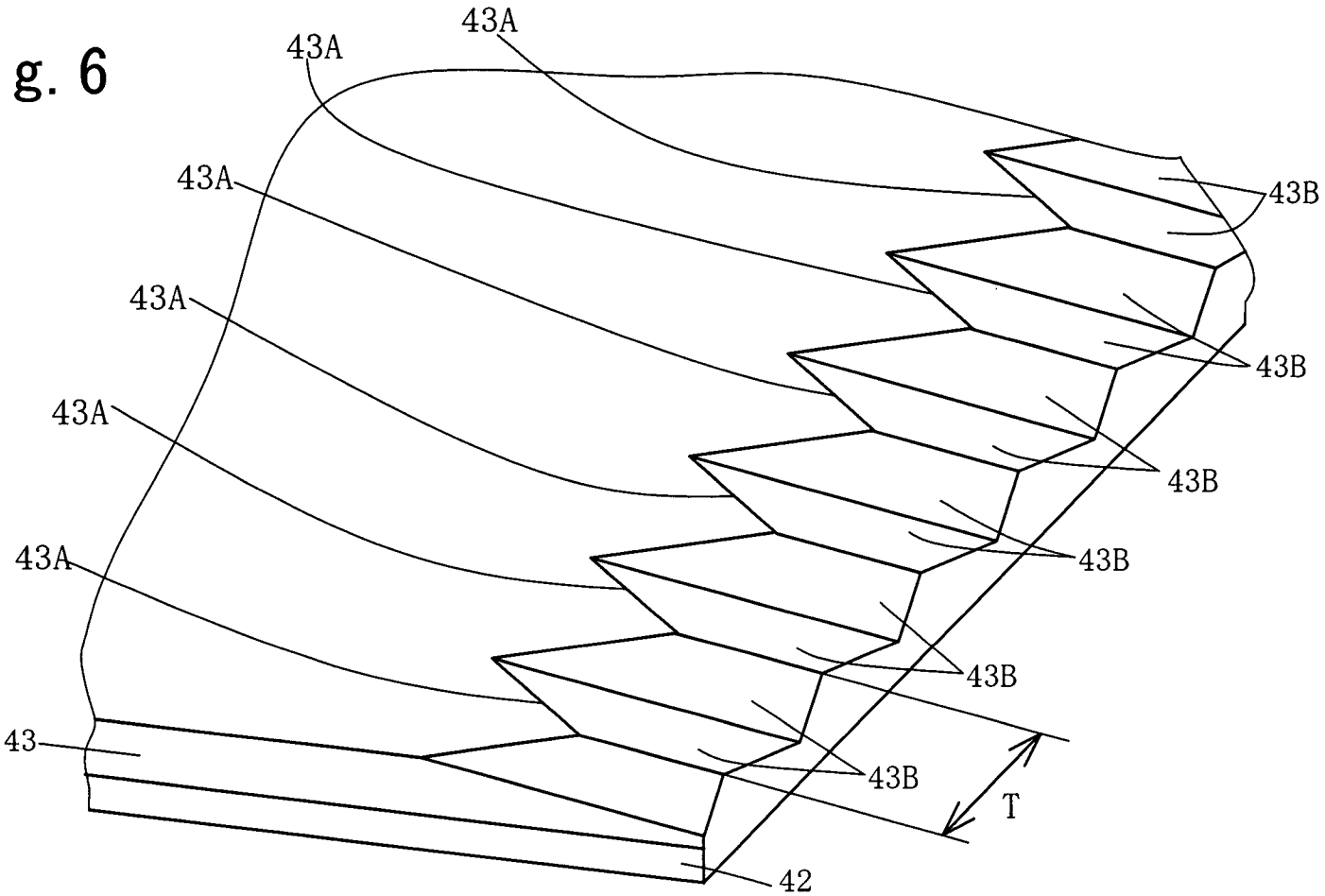
FIG. 6 is an enlarged fragmentary perspective view showing a support table of the apparatus of FIG. 1.

Referring to FIGS. 1 to 3, a pair of upstanding side wall members 22 is fixedly mounted at the bottom thereof to the frame base 20 and a shaft 24 is fixed at the opposite ends thereof to the side wall members 22. One wall member 22 is indicated by chain double-dashed line in FIG. 3. A plurality of generally L-shaped pressing lever arms 28 is rotatably mounted on the shaft 24 via bearings 26 at positions corresponding to the spacers 4 between the cutters 3 on the drive shaft 2. Reference numeral 30 designates a wall member disposed upstanding behind the pressing lever arms 28, or on the left-hand side as seen in FIG. 3, in perpendicular relation to and fixed at the opposite sides thereof to the side wall members 22. An air cylinder 32 is pivotally connected at the proximal end thereof to the wall member 30 and at the end of the piston rod 32A thereof to one end of each of the pressing lever arms 28. A pressing member 34 is pivotally connected to each pressing lever arm 28 at the other end thereof opposite from the end to which the air cylinder 32 is connected. As shown in FIG. 5, each pressing member 34 has a width, as measured in the axial direction of the shaft 24, that is slightly smaller than the space between any two adjacent cutters 3, so that the pressing member 34 is pivotable relative to its corresponding pressing lever arm 28. The air cylinder 32 is connected to the control unit 70 to receive control signals therefrom.

Figure 10:
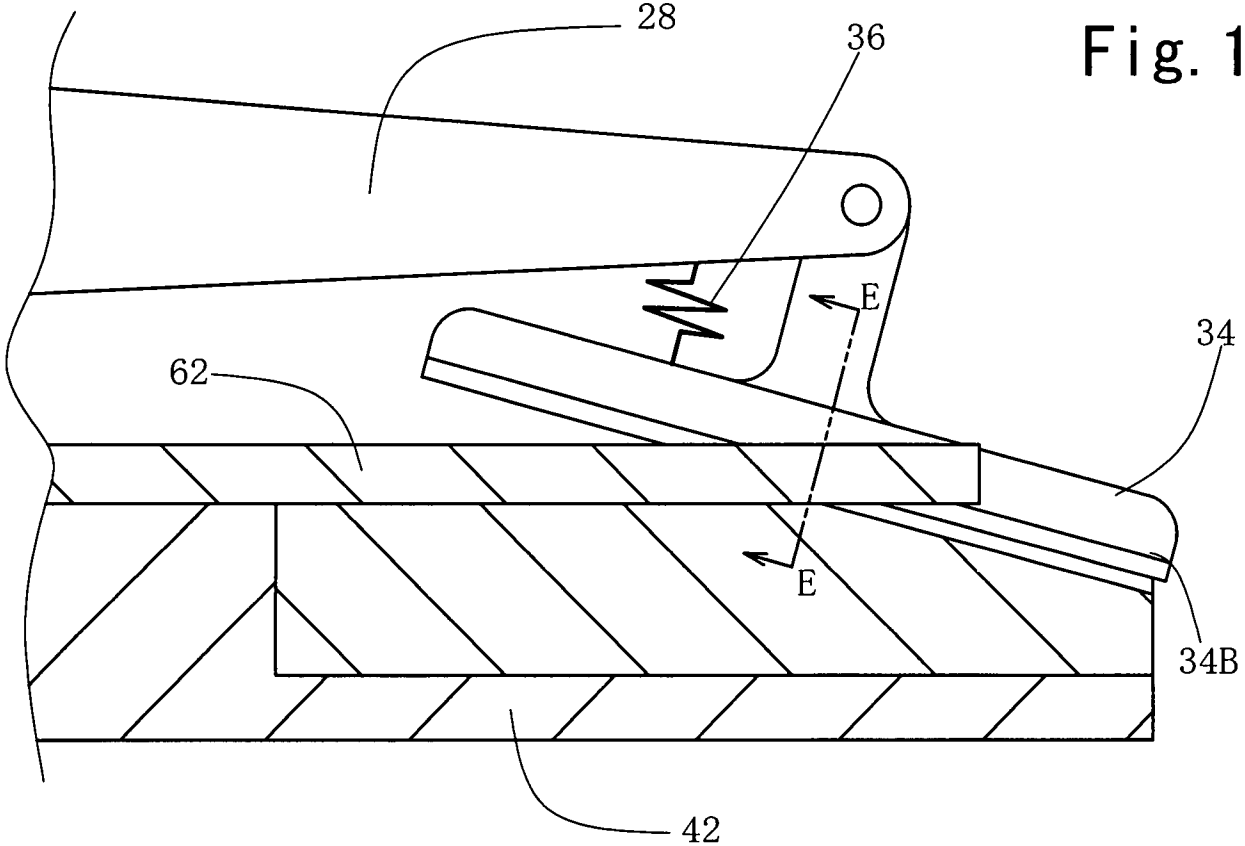
FIG. 10 is an enlarged fragmentary view showing the pressing member of the pressing arm pressing the wood board at a first bevel cut thereof.
Figure 11:
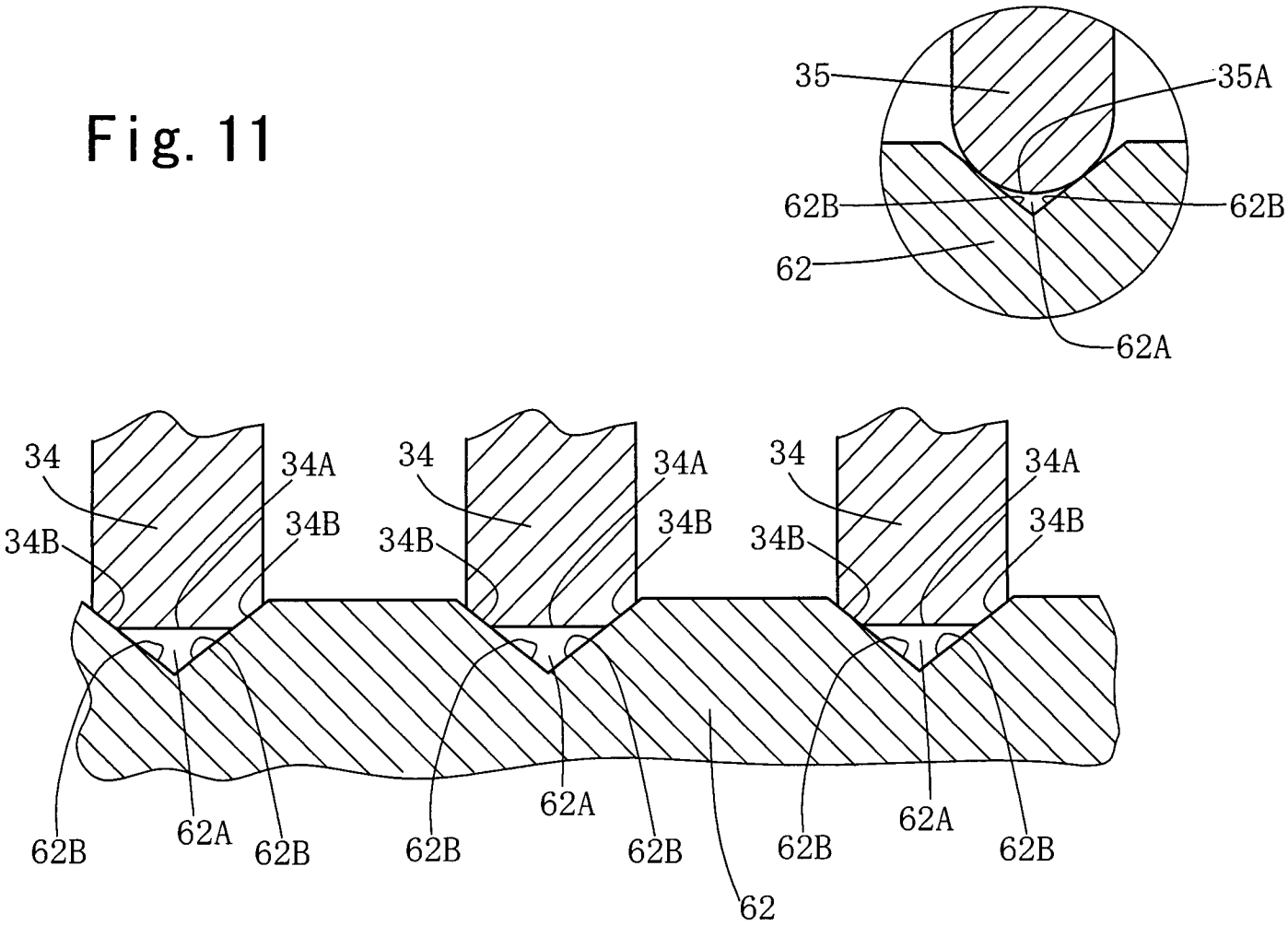
FIG. 11 is an enlarged fragmentary view as seen in arrow direction E-E of FIG. 10.

As shown in FIGS. 5 and 11, the pressing member 34 is formed at the bottom thereof with a flat broad surface 34A and two beveled surfaces 34B on the opposite sides of the broad surface 34A. The flat broad surface 34A is formed so as to be pressingly contactable with the top flat surface of a wood board 62 placed on the aforementioned support table 42 and is yet to be formed with first bevel cuts 62A, while the beveled surfaces 34B are formed so as to be pressingly contactable with part of bevel-cut surfaces 62B of the first bevel cuts 62A, as will be described more in detail in later part hereof with reference to FIG. 10.

A weak tension spring 36 is connected between each pressing lever arm 28 and its corresponding pressing member 34 for urging the pressing member 34 to be inclined when the pressing member 34 is placed in its raised inoperative position, as shown in FIG. 3, for the reason as will be described in later part hereof. The tension of the spring is set just strong enough to urge the pressing member 34 in the position shown in FIG. 3. The pressing lever arm 28 is pivotable about the shaft 24 by extending and retracting movement of the piston rod 32A of its corresponding cylinder 32 that is operable in response to a signal from the control unit 70.

The support table 42 is made of a steel block and supports on the top surface thereof a wood board 62. The support table 42 has an insert plate 43 fixed at the downstream end with respect to the board feeding direction that is indicated by arrow located just above the wood board 62, or at the right-hand side end of the support table 42 as viewed in FIG. 3. The insert plate 43 is made of a material that is rigid, but not so hard that the cutting edge 3A of the rotating cutter 3 is damaged by contact thereof with the insert plate 43, such as rigid synthetic resin, compressed wood. The support table 42 is shiftable in the first direction that is parallel to the drive shaft 2 and perpendicular to the wood board feeding direction. For this purpose, two height adjustment blocks 44 are fixed on the frame base 20 at a spaced distance in the second direction, or in the board feeding direction, and the support table 42 is mounted to such blocks 44 by way of linear bearings each having a stationary linear base 46B fixed to the top surface of its corresponding height adjustment block 44 and a slide 46A that is movable along the stationary linear base 14B in the first direction and to which the support table 42 is fixed at the bottom thereof.

For shifting the support table 42 in the first direction, an air cylinder 48 is provided between the frame base 20 and the support table 42. As indicated by dotted line in FIG. 1, the air cylinder 48 is pivotally connected at the proximal end thereof to one side wall members 22 (or the wall member 22 on the lower side as seen in FIG. 1) and at the distal end of the piston rod 48A thereof to a mounting 20A fixed to the bottom of the support table 42. In such arrangement, extending and retracting motion of the piston rod 48A of the air cylinder 48 causes the support table 42 to shift in opposite first directions. The support table 42 is shiftable for a distance T of about 24 mm indicated by double-headed arrow between the first and the second positions in FIG. 1. The distance T corresponds to the width T of the cutter 3. The support table 42 is placed in its first position when the piston rod 48A of the air cylinder 48 is retracted and shifted to its second position when the piston rod 48A is extended. For regulating the shifting movement of the support table 42 between the first and the second positions, there are provided two stops at any appropriate positions in the apparatus. The air cylinder 48 is connected to the control unit 70 to receive control signals therefrom.

Referring to FIGS. 1 and 3, there is provided a pair of wall members 52 (indicated by solid line and dash-dotted line in FIGS. 1 and 3, respectively) fixed to and upstanding from the top surface of the support table 42 at positions spaced in the first direction. A plate 55 is fixed between the wall member 52A and a shaft 54 is fixed at the opposite ends thereof to the paired wall members 52. A plurality of hold-down lever arms 58 (only one arm being shown in FIG. 3) is rotatably mounted on the shaft 54 through bearings 56 at a predetermined spaced distance. Each lever arm 58 has at one end thereof a blade-like hold-down member 50 and the opposite top end of the lever arm 58 is connected to the piston rod 60A of an air cylinder 60 which is pivotally connected to the plate 55. In such an arrangement, extending and retraction operation of the air cylinder 60 causes the lever arm 58 to turn about the shaft 54 between the raised inoperative position (indicated by solid line) and the lowered operative position (indicated by dashed line) where the blade-like hold-down member 50 holds a wood board 62 firmly against the support table 42 by engaging with the top surface of the wood board 62.

Holding of the wood board 62 against the support table 42 by the hold-down members 50 is done for the purpose of preventing the wood board 62 from being displaced on the support table 42 by any force produced when the cutters 3 cut bevels at the end of the wood board 62. The force with which the blade of the hold-down member 50 engages with the wood board 62 should be adjusted depending on the board material characteristics so that the wood board 62 is held firm enough to prevent the displacement of the board 62 relative to support table 42 during the bevel cut forming by the cutters 3. The air cylinders 60 for the respective lever arms 58 are connected to the control unit 70 to receive control signals therefrom.

Referring to FIGS. 1 and 3, reference numeral 64 designates a plurality of feeding rolls (only one roll being shown in the drawings) that are operatively connected to a servomotor 66 and rotatable in arrow direction for moving a wood board 62 toward and onto the support table 42. A board sensor 68 is located at a position adjacent to and upstream of the hold-down lever arms 58 for detecting the arrival of an incoming wood board 62. The board sensor 68 is connected to the control unit 70 and transmits a detection signal to the control unit 70 when a wood board 62 is detected. Receiving detection signals from the board sensor 68, the control unit 70 is operated to control the operation of various devices of the apparatus.

As shown in FIGS. 3 and 5 through 9, the insert plate 43 of the support table 42 is formed at the downstream end thereof with respect to the wood board feeding direction with a cutout 43A for allowing the cutters 3 to move past the support table 42 without interfering with the support table 42. Such cutout 43 is formed previously in a manner as explained below.

With the air cylinder 48 kept in its retracted position, the support table 42 that is yet to have a cutout in its insert plate 43A is set in its first position indicated by solid line in FIG. 1. The servomotor 18 is activated to drive the cutters 3 to rotate in arrow direction and then the paired servomotors 15 are activated to rotate the respective leadscrews 10 in forward direction thereby to move the cutter assembly 1 forward (or rightward as seen in FIG. 3) along the linear bearings 14 until the lowered position (dotted-line position in FIG. 3) is reached. The servomotor 18 is stopped and the servomotors 15 are driven in reverse direction thereby to rotate the leadscrews 10 reverse, so that the cutter assembly 1 is returned to its raised retracted position.

Subsequently, the air cylinder 48 is actuated to extend its piston rod 48A thereby to shift the support table 42 to its second position indicated by chain double-dashed line in FIG. 1. Then, the servomotor 18 is activated to drive the cutters 3 to rotate in the same direction and then the paired servomotors 15 are activated for moving the cutter assembly 1 in forward direction again until the lowered position is reached, whereupon the cutter assembly 1 is returned to its original raised position in the same manner as in the above case. As a result, a cutout 43, i.e. a plurality of V-shaped groove-like bevel cuts, is made at the edge of the insert plate 43 of the support table 42, as most clearly shown in FIG. 6. As shown in the drawing, the V-shaped bevel cuts of the cutout 43A are formed at an interval T of about 24 mm that corresponds to the cutting width T of the cutter 3 and each bevel cut of the cutout 43A is formed by two inclined surfaces 43B.

The following will describe the first embodiment of the bevel cut forming method according to the present invention by way of explaining the operation of the above-described apparatus.

In the initial setting of the apparatus, the piston rods 32A of the respective air cylinders 32 are retracted so that their corresponding pressing lever arms 28 are placed in their inoperative position and the piston rods of the air cylinders 60 are extended so that their corresponding hold-down lever arms 58 are placed in their inoperative position, as shown in FIG. 3. The piston rod of the air cylinder 48 is retracted so that the support table 42 is placed in its first position that is indicated by solid line in FIG. 1. The servomotor 66 is operating and the feeding rolls 64 are running, accordingly. The cutter assembly 1 is placed at its raised position shown in FIG. 3 and the cutters 3 are at a stop.

With the apparatus thus set in the initial condition, a wood board 62, i.e. a plywood board with a thickness of about 12 mm and a rectangular shape having a straight end, is placed on the feeding rolls 64. The wood board 64 on the feeding rolls 64 is moved in the second direction and conveyed toward the support table 42. As the board sensor 68 detects the arrival of the leading end of the incoming wood board 62, the sensor 68 generates a detection signal to the control unit 70. Responding to the detection signal, the control unit 70 firstly stops the servomotor 66 and hence the feeding rolls 64 at such a time that the leading end of the wood board 62 reaches a position adjacent to the front end of the support table 42. Specifically, the wood board 62 is stopped at such a position that part of the V-shaped cutout 43A in the insert plate 43 of the support table 42 is just covered by the leading end of the wood board 62, as shown in FIG. 3. Thus the wood board 62 is placed on the support table with the leading end of the wood board 62 located adjacent to the end of the support table 42. The pressing member 34 then urged by the spring 36 as shown in FIG. 3 allows the wood board 62 to move without interfering with the pressing member 34.

Figure 7:
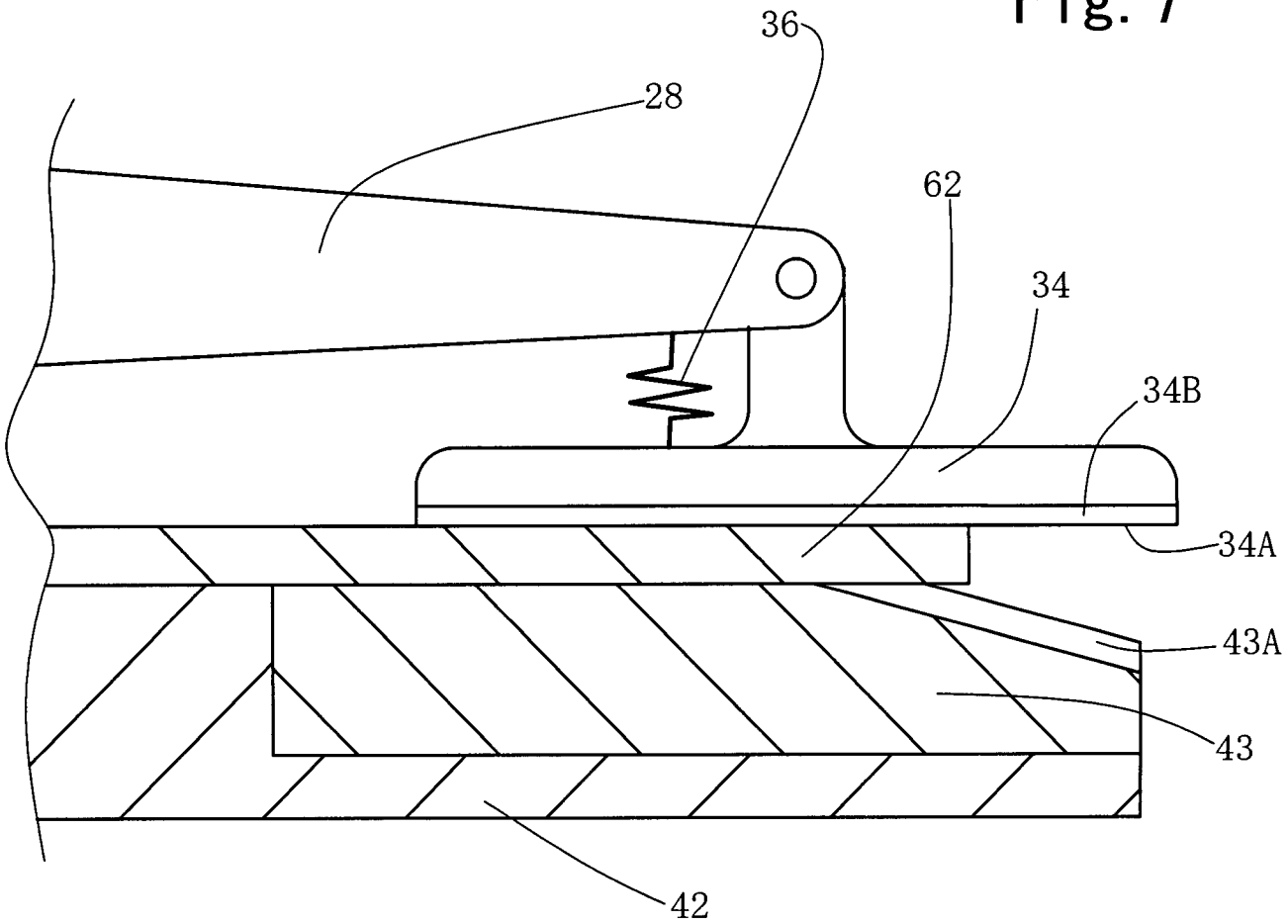
FIG. 7 is an enlarged fragmentary view showing a wood board being pressed against the support table by pressing member of the pressing arm.

The control unit 70 then operates the air cylinders 32 so as to extend their piston rods 32A and also the air cylinders 60 so as to retract their piston rods 60A. As a result, the pressing lever arms 28 are pivoted on the shaft 24 from their inoperative position of FIG. 3 to their operative position where the flat broad surface 34A of each pressing member 34 presses the wood board 62 against the support table 42. By so doing, any warp or bend of the wood board 62 at the end thereof is corrected by being straightened, as shown in FIG. 7. Operating the cylinders 60, the hold-down lever arms 58 are turned in counter-clockwise direction as seen in FIG. 3 to their operative position where the blade-like hold-down members 50 are engaged with the top surface of the wood board 62, as indicated by chain double-dashed line in FIG. 3.

After the wood board 62 is thus held firmly against the support table 42, the control unit 70 generates a signal to start the servomotor 18 thereby to rotate the cutters 3 in arrow direction (FIG. 3) and a signal to start the servomotors 15 thereby to rotate the leadscrews 10 synchronously in forward direction. Accordingly, the cutter assembly 1 is moved downward along the linear bearings 14, that is, in a direction that extends in a perpendicular relation to the straight end of the wood member 62 placed on the support table 42 as viewed from the top of the apparatus and is inclined with respect to the opposite surfaces of the wood member 62 placed on the support table 42.

Figure 8:
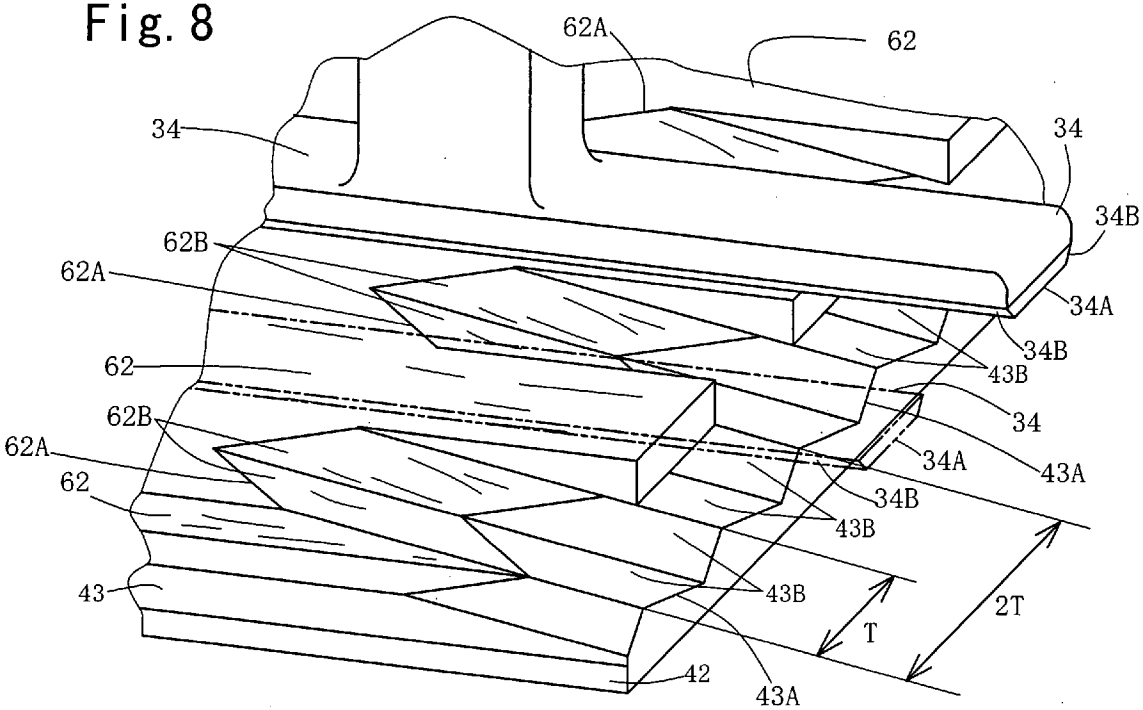
FIG. 8 is a fragmentary perspective view showing a plurality of first bevel cuts formed at an end of the wood board.

As a result, the leading end of the wood board 62 is cut by the cutters 3, as shown in FIG. 8. Specifically, the wood board 62 is formed at the end thereof with a plurality of first V-shaped groove-like bevel cuts 62A spaced at an interval 2T of about 48 mm, each extending from one surface to the other of the wood board 62 and having a width T along the end of the wood board 62 and two contiguous surfaces 62B inclined so as to form a V-shape at any section across the bevel cut 62A. The provision of the cutout 43A formed in the insert plate 43 allow the rotating cutter 3 to move past the end of the support table 42 without mechanically interfering therewith. The leading end of the wood board 62 is pressed down by the pressing members 34 of the pressing lever arms 28 firmly against the support table 42 during the cutting, so that bevel cuts of a uniform shape are formed. As shown in FIG. 8, the inclined surfaces 62B of a first bevel cut 62A are formed continuously with the surfaces of the cutout 43A in the insert plate 43 of the word table 42. The blade-like hold-down members 50 of hold-down lever arms 58 engaged with the top surface of the wood board 62 serve to hold the wood board 62 in place without allowing any displacement thereof relative to the support table 42. Since the wood board 62 is supported from the bottom in contact with the support table 42 except the area of the bottom just above the cutout 43A in the insert plate 43, the cutting of the bevel cuts 62 is accomplished with smoothness and high accuracy.

After the first bevel cuts 62A have been formed, the control unit 70 operates the air cylinders 32 so as to retract their piston rods 32A thereby to return the pressing lever arms 28 and hence the pressing members 34 to their original inoperative positions of FIG. 3. Then, the air cylinder 48 is operated by a signal from the control unit 70 so as to extend its piston rod 48A. Accordingly, the support table 42 is shifted to from its first position to its second position by moving for a distance T of about 24 mm in the first direction along the linear bases 46B of the linear bearings 46. The wall members 52 fixed to the support table 42 are moved together with the support table 42, so that the lever arms 58 with their hold-down members 50 engaged with the wood board 62 are moved with the wood board 62 and, therefore, the wood board 62 is moved without altering its position relative to the support table 42. Thus shifting support table 42, the wood board 62 is placed with their first bevel cuts 62A positioned just below the respective pressing members 34.

The control unit 70 then operates the air cylinders 32 to as to extend their piston rods 32A thereby to pivot the pressing lever arms 28 clockwise on the shaft 24, so that the pressing members 34 are moved to their operative position of FIG. 10 where the pressing members 34 are pressed against the wood board 62. Specifically, as shown in FIG. 11, the pressing member 34 are pressed at the beveled surfaces 34A thereof against the cut surfaces 62B of the first bevel cuts 62A, thus making leading end of the wood board 62 flat on the support table 42 as shown in FIG. 10.

Figure 9:
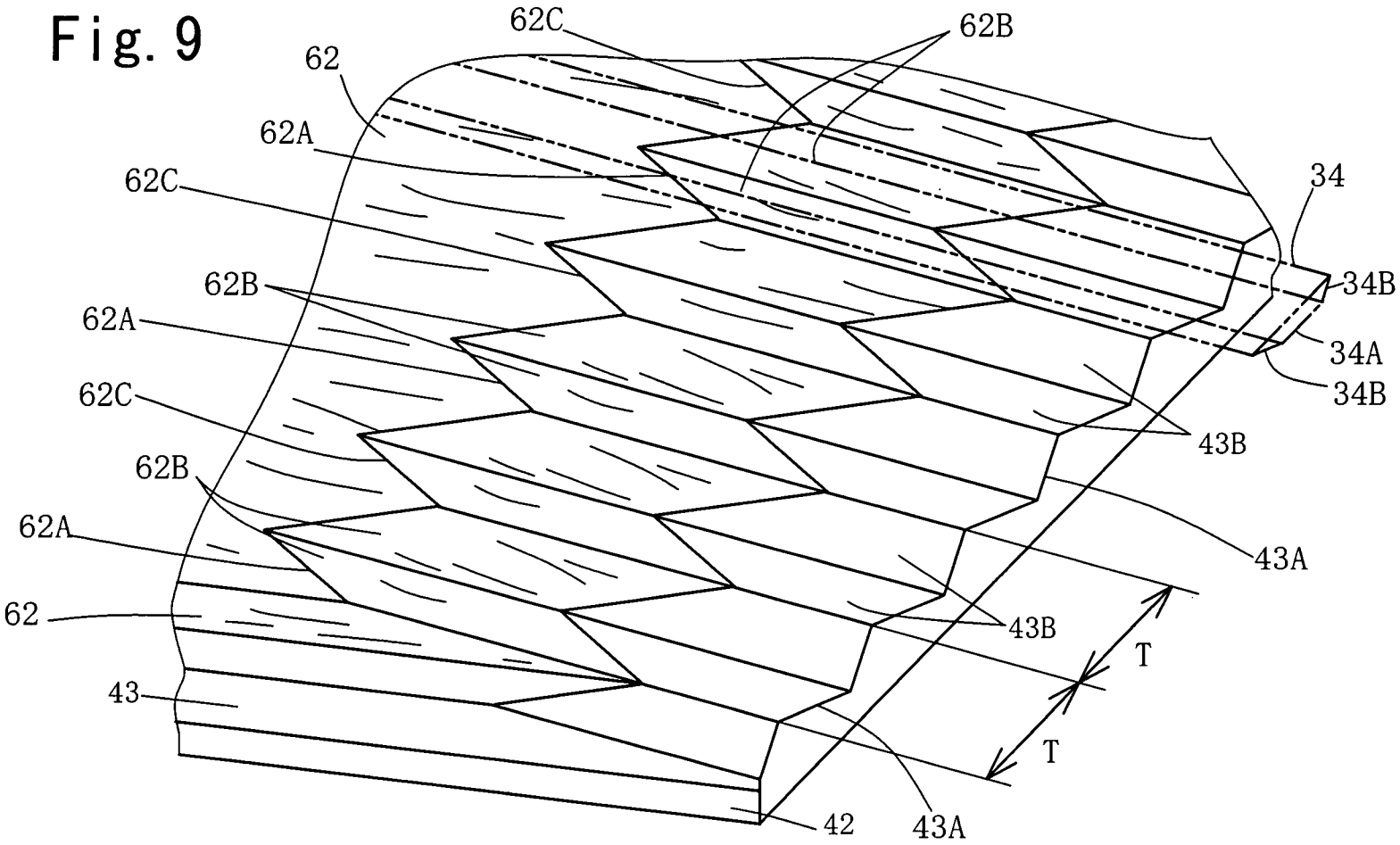
FIG. 9 is also a fragmentary perspective view showing a plurality of second bevel cuts, as well as the first bevel cuts, formed at the end of the wood board of FIG. 8.

The control unit 70 generates a signal to activate the servomotor 18 to rotate the cutter 3 in arrow direction and then a signal to activate the servomotors 15 to rotate the leadscrews 10 in reverse direction. Accordingly, the cutter assembly 1 is moved upward along the linear bearings 14. Thus, the leading end of the wood board 62 is cut by the cutters 3 and a plurality of second bevel cuts 62C similar to the first bevel cuts 62A, each located between any two adjacent first bevel cuts 62A is formed at the leading end of the wood board 62 at an interval 2T of about 48 mm. As a result, a series of V-shaped groove-like bevel cuts 62A and 62C is formed at the leading end of the wood board 62 at an interval T of about 24 mm, as shown in FIG. 9.

The following will describe the second embodiment of the bevel cut forming method according to the present invention by way of describing an apparatus usable for practicing the method and the operation thereof with reference to FIGS. 11 through 18. The apparatus used for the second embodiment differs the apparatus described with reference to FIGS. 1 through 10 mainly in that the pressing members 34 are configure to be movable in the second direction.

In the following description, those devices, parts or elements which are common in the apparatuses for the bevel cut forming method according to the first and second embodiments are designated by the same reference numerals and the detailed description thereof will be omitted. It is noted that some of the common devices, parts or elements such as the leadscrews 10, the servomotors 15, the guide blocks 9 and their related parts are omitted from the illustration in the drawings. Furthermore, terms representing the directions and positions, i.e. the first and second directions indicated by arrows and the first and second position of the support table in FIG. 1 will be also used in the following description.

Figure 12:
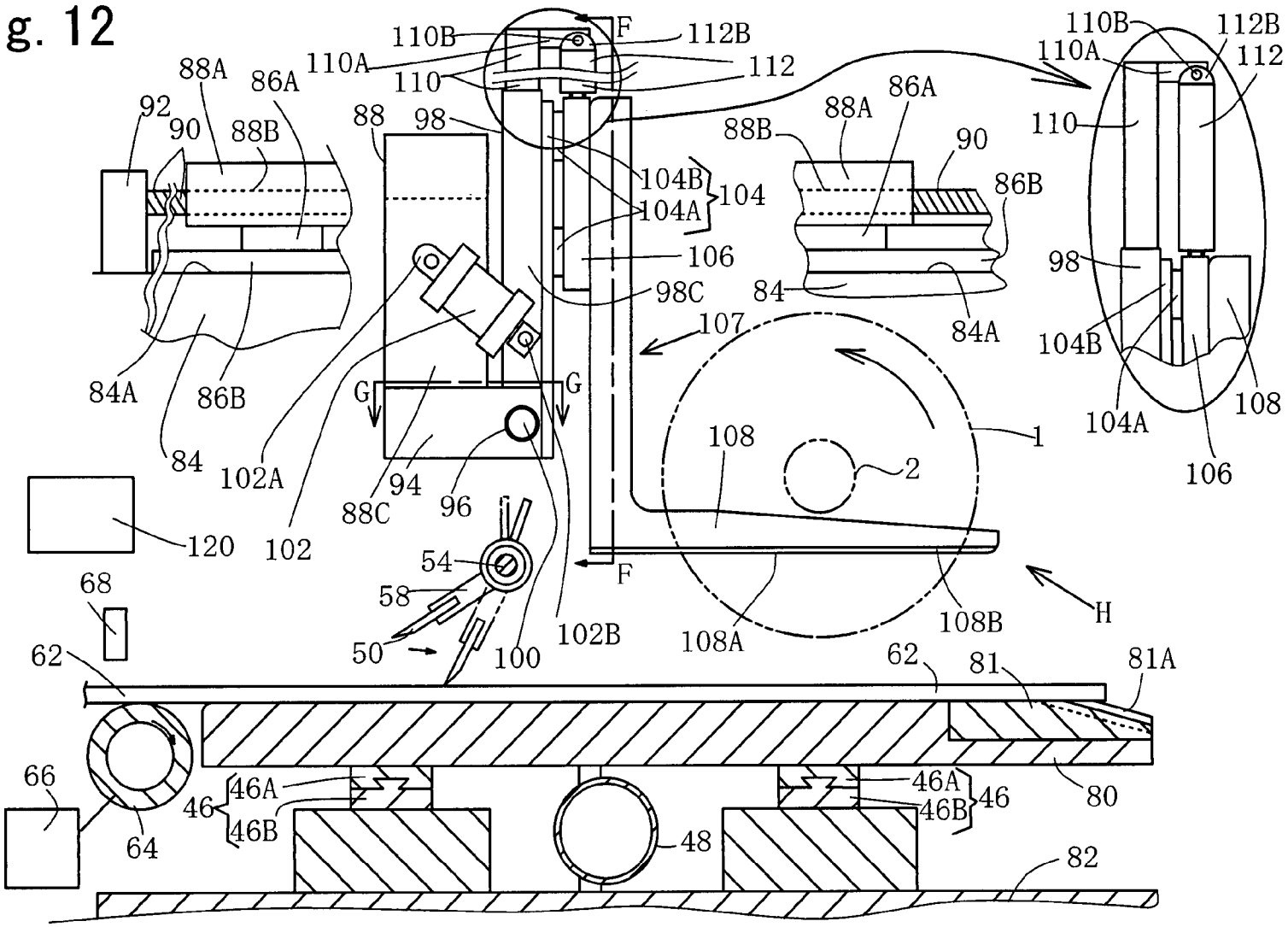
FIG. 12 is a side view similar to FIG. 3, but showing an apparatus used for practicing a second embodiment of the method for forming a bevel cut at an end of a wood board according to the present invention.

Referring to FIG. 12, the support table is designated by 80 and the frame base by 82, respectively. As in the case of its counterpart 42 in FIG. 3, the support table 80 is mounted to the linear bearings 46 for shifting movement between the first and second positions and has at the downstream end thereof as view in the board feeding direction the insert plate 81 that is made of the same material and formed previously with a cutout 81A corresponding to the cuts 43A. The support table 80 differs from the counterpart 42 of FIG. 3 mainly in that the former table 80 is formed longer than the latter table 42 by extending further than the table 42 in upstream direction. The frame base 20 of the apparatus is formed longer, accordingly. The hold-down lever arm 58 and its related parts and elements are operable in the same manner as the counterparts of FIG. 3.

Figure 13A:
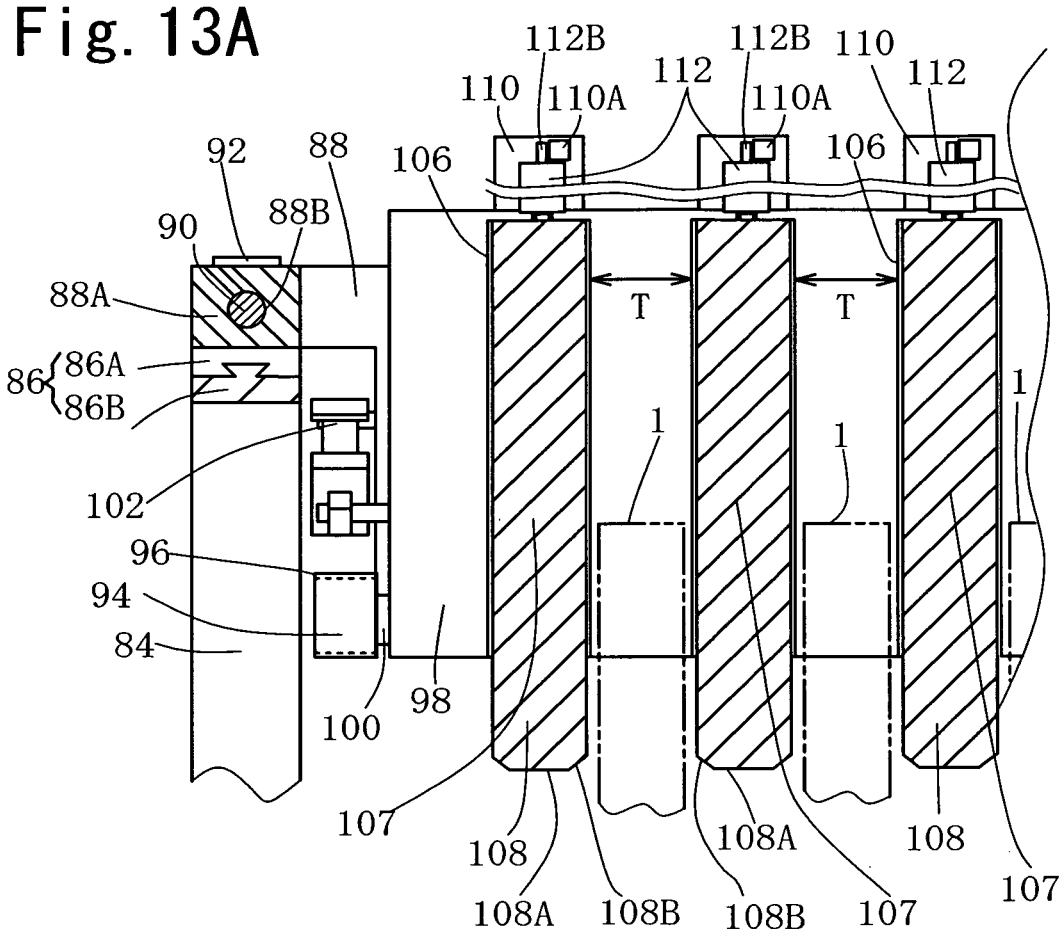
FIG. 13A is a fragmentary partially sectional view as seen in arrow direction F-F of FIG. 12.
Figure 13B:
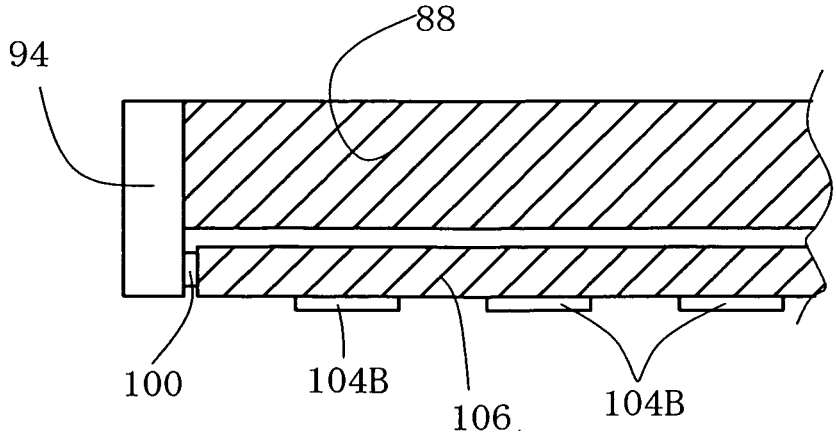
FIG. 13B is also a fragmentary partially sectional view as seen in arrow direction G-G of FIG. 12.

Referring to FIGS. 12 and 13A, numeral 107 designates a plurality of L-shaped pressing arms (only one arm being shown in FIG. 12) spaced along the first direction and each having a generally horizontal pressing member 108 with a flat broad surface 108A and beveled surfaces 108B on the opposite sides of the broad surface 108A. Though shown only fragmentarily in FIGS. 12 and 13A for the sake of clarity of illustration, a pair of parallel wall members 84 (only one being shown in the drawings) is fixed at the bottom thereof to the frame base 82 of the apparatus, extending in the second direction. Reference numeral 86 designates a pair of linear bearings (only one bearing being shown in FIGS. 12 and 13A) each including a stationary linear base 86B fixed to the top 84A of its corresponding wall member 84 and a slide 86A that is movable along the stationary linear base 86B. Reference numeral 88 designates a pair of carriage blocks (only one block being shown in FIGS. 12, 13A and 13B) each having an elongated block 88A fixed to the movable slide 86A of its corresponding linear bearing 86 and extending in the second direction. Each elongated block 88A has formed axially therethrough a threaded hole 88B that receives therein a leadscrew 90, one end of which is connected to a servomotor 92 for driving the leadscrew 90 to rotate. Each servomotor 92 is connected to the control unit 120 and operable to rotate reversibly in response to control signals transmitted from the control unit 120 thereby to move the carriage blocks 88 reversibly in the second direction.

Figure 18:
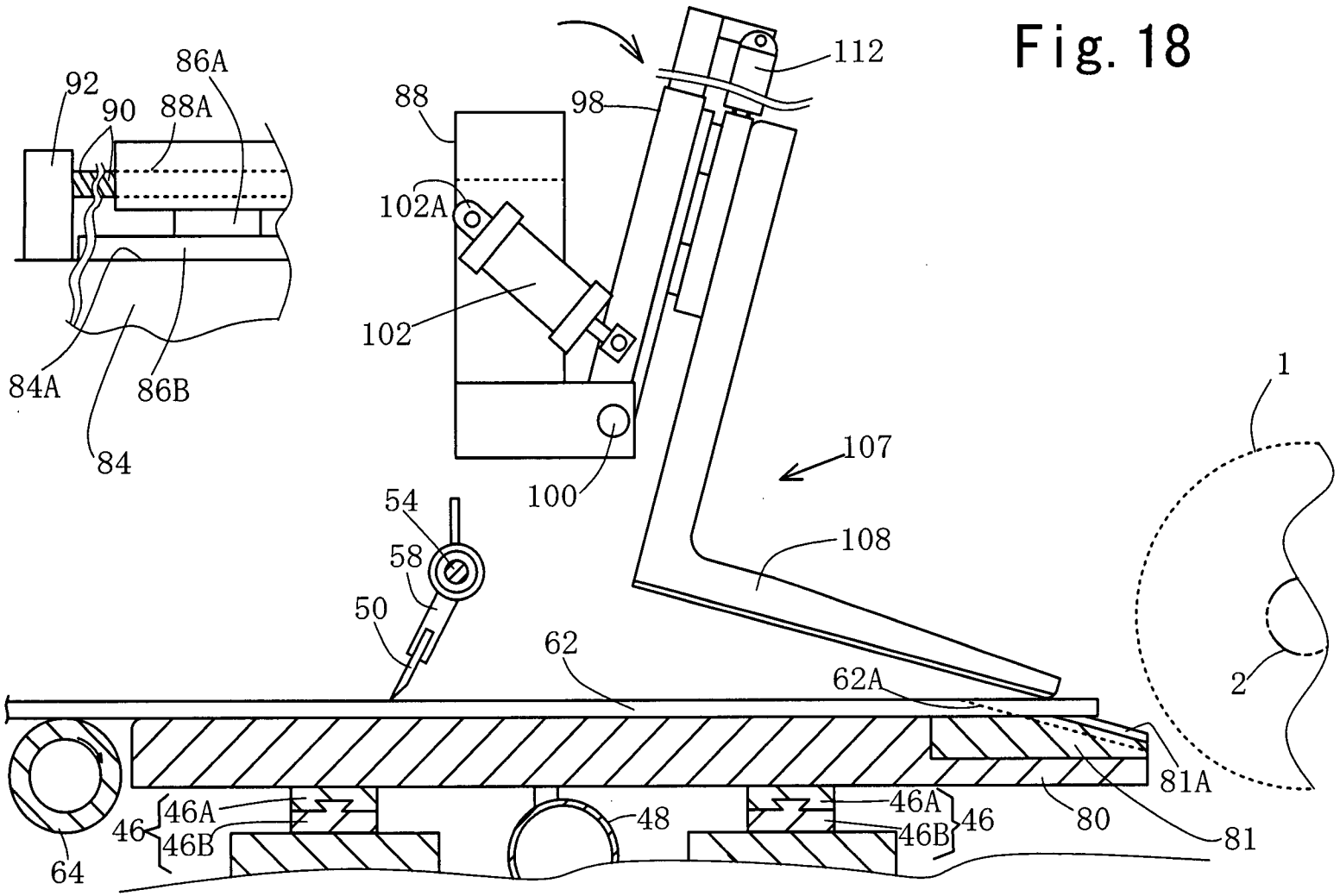

The paired carriage blocks 88 are fixed at the bottom thereof to respective horizontal support members 94 each having therein a bearing 96. A support shaft 100 is rotatably supported by the bearings 96 in the support members 94. A vertical support member 98 is pivotably mounted on the shaft 100 and a pair of air cylinders 102 (only one cylinder being shown) is connected between the vertical support member 98 and the respective carriage blocks 88. Specifically, the air cylinder 102 is connected at the proximal end 102A thereof to the side face 88C of the carriage block 88 and at the end of the piston rod 102B thereof to the side face 98C of the vertical support member 98. The air cylinders 102 are connected to the control unit 120 to receive therefrom control signal to cause the support members 98 to pivot or swing on the shaft 100. The aforementioned L-shaped pressing arms 107 are mounted to the vertical support member 98 by way of linear bearings 104, although the details of the mounting will be explained below. By so constructing, when the air cylinders 102 are operated to extend their piston rods 102B, the vertical support member 98 and hence the L-shaped pressing arms 107 mounted to the support member 98 by way of linear bearings 104 are tilted as shown in FIG. 18. The air cylinders 102 are so configured that, when the piston rods 102B are fully extended, the pressing arms 107 are tilted with the bottom flat surface 108A of the pressing member 108 thereof inclined in substantially parallel relation to the inclined linear bearings 14.

Figure 15:
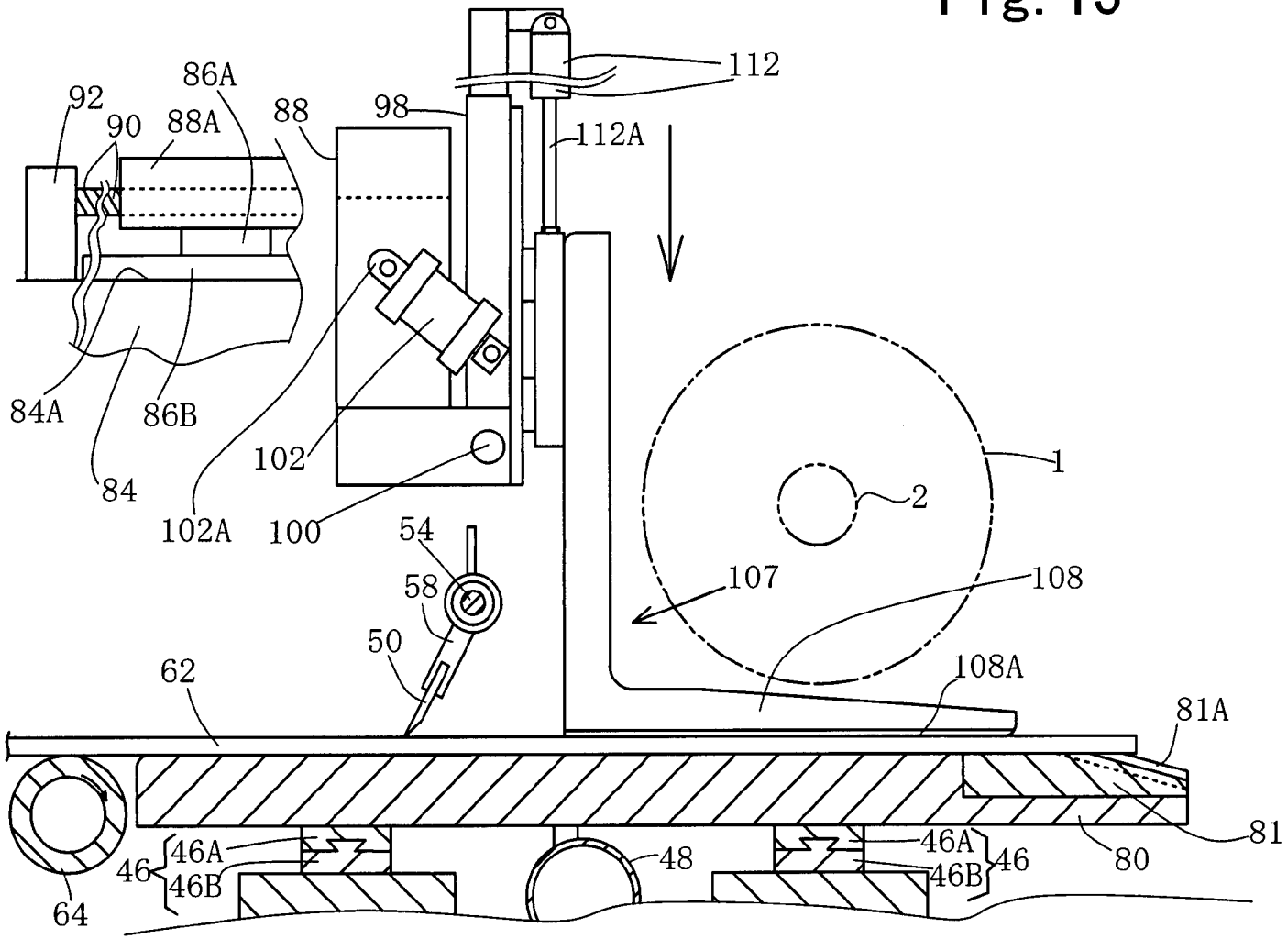
FIGS. 15 through 21 are illustrative views showing various steps of operation of the apparatus of FIG. 12.

As mentioned above, the pressing arms 107 are mounted to the vertical support member 98 by way of a plurality of linear bearings 104. The linear bearings 104 are provided for the respective pressing arms 107, each including a stationary linear base 104B fixed to the vertical support member 98 on the side thereof opposite from the carriage block 88 and a slide 104A that is movable along its corresponding stationary linear base 104B. A slide member 106 is fixed to the movable slide 104A of each linear bearing 104 and the pressing arm 107 is fixedly mounted to the slide member 106. Thus, the slide member 106 and the pressing arm 107 are movable together relative to the support member 98 along the stationary linear base 104B of the linear bearing 104 between the elevated position (FIG. 12) and the lowered position (FIG. 15).

Figure 14:
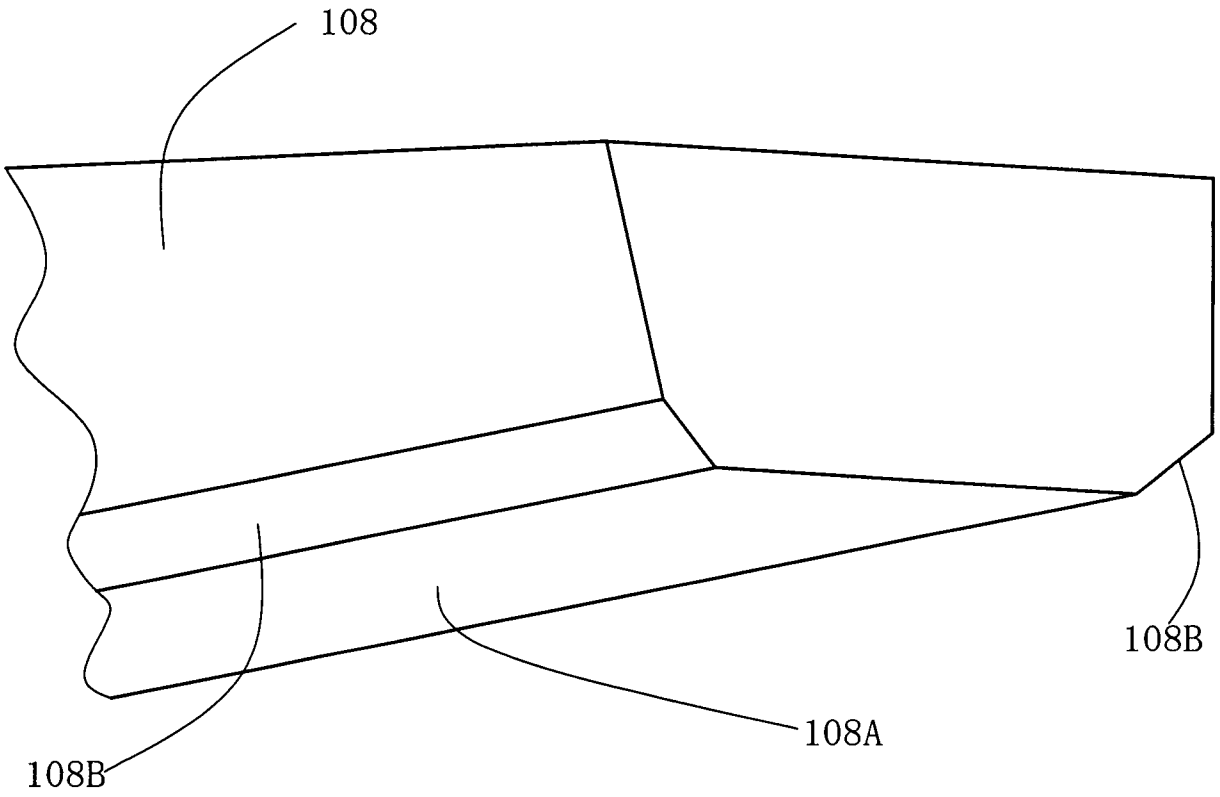
FIG. 14 is fragmentary perspective view as seen in arrow direction H of FIG. 12, showing the bottom of a pressing member.

As shown in FIG. 14, the bottom of the pressing member 108 is formed with a flat broad surface 108A and two beveled surfaces 108B located on the opposite sides of the broad surface 108A as in the case of the pressing member 34 shown in FIG. 5.

Referring to FIGS. 12 and 13A, a mounting block 110 is fixed to the top end of each vertical support member 98 at a position corresponding to the stationary base 104B of each linear bearing 104. The mounting block 110 has a horizontal arm 110A extending forward in the second direction and having therein a support shaft 110B. Reference numeral 112 designates a plurality of air cylinders each having its proximal end 112B connected to the support shaft 110B and the end of the piston rod 112A thereof connected to the top of the slide member 106. Each air cylinder 112 is connected to the control unit 120 to receive therefrom control signals. In such an arrangement, extending and retracting motions of the piston rods 112A of the air cylinders 112 cause the pressing arms 107 to be lowered and elevated relative to the vertical support member 98.

In FIG. 12, a wood board 62 is shown placed on the support table 80. The feeding rolls 64 (only one being shown in the drawing), the servomotor 66 for driving the feeding rolls 64 and the board sensor 68 are of the same structure and perform the same function as their counterparts in the apparatus shown in FIG. 3. The control unit 120 receives detection signals from the board sensor 68 and is operated to control the operation of various devices of the apparatus, as will be described in detail below. For the sake of illustration of FIG. 12, the cutter assembly 1 is indicated only by chain double-dashed line.

The following will describe the second embodiment of the bevel cut forming method according to the present invention by way of explaining the operation of the apparatus of FIG. 12.

In the initial setting of the apparatus, the paired carriage block 88 are placed in their retracted position, as shown in FIG. 12, and the hold-down lever arms 58 are placed in their inoperative position, as indicated by solid line in FIG. 12. The vertical support member 98 is set in its upright position and the slide members 106 are set in their elevated position, respectively, as shown in FIG. 12. The cutter assembly 1 is placed at its raised position as indicated by chain double-dashed line in FIG. 12, the support table 80 is placed in its first position, and the feeding rolls 64 are running in arrow direction.

With the apparatus thus set in the initial condition, a wood board 62 is placed on the feeding rolls 64 and moved toward the support table 80. As the board sensor 68 detects the arrival of the leading end of the incoming wood board 62, the sensor 68 generates a detection signal to the control unit 70. Responding to the detection signal, the control unit 70 firstly stops the servomotor 66 and hence the feeding rolls 64 at substantially the same time as in the case of the first embodiment in FIG. 3.

Simultaneously, the control unit 120 generates a signal to activate the servomotor 18 thereby to rotate the cutters 3 in arrow direction. After an elapse of time that is long enough for the wood board 62 to be stopped on the support table 80, the control unit 120 operates the air cylinders 60 to retract their piston rods so that the hold-down lever arms 58 are rotated in counter-clockwise direction as seen in FIG. 12 to their operative position where the blade-like hold-down members 50 are engaged with the top surface of the wood board 62 as in the case of the first embodiment, as indicated by chain double-dashed line in FIG. 12. Then, the control unit 70 operates the cylinders 112 to extend their piston rods 112A thereby lowering the L-shaped pressing arms 10. As a result, the horizontal pressing member 108 presses at the flat bottom surfaces 108A the wood board 62 against the support table 80 at positions adjacent to the leading end the of the wood board 62, as shown in FIG. 15.

Figure 16:
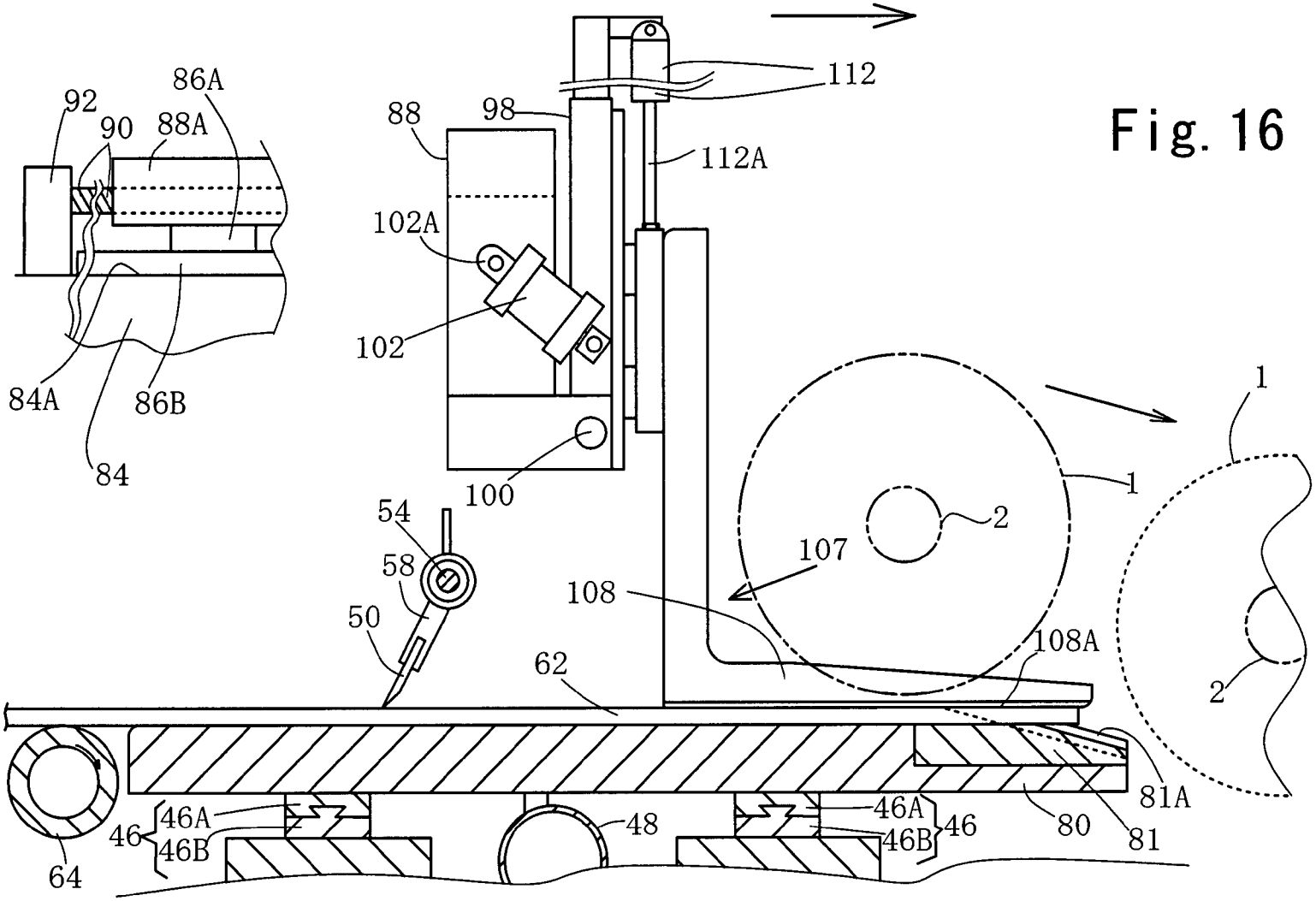

After the wood board 62 is thus pressed against the support table 42 by the pressing members 108, the control unit 70 generates a signal to drive the servomotors 15 thereby to rotate the leadscrews 10 synchronously in forward direction. Accordingly, the cutter assembly 1 is moved downward along the linear bearings 14. Simultaneously with the operation of the servomotors 15, the control unit 70 activates the servomotors 92 thereby to rotate the leadscrews 90 synchronously in forward direction for moving the paired carriage blocks 88 and hence the pressing arms 107 in arrow direction with the flat bottom surfaces 18A of the pressing members 108 kept in sliding contact with the top surface of the wood board 62, as shown in FIG. 16. In this case, the carriage blocks 88 are moved forward while maintaining clearances between the cutters 3 and the vertical portions of the pressing arms 107 in the second direction to prevent mechanical interference therebetween. For the wood board 62 to be pressed firmly before the cutting by the cutters 3 begins, the pressing members 108 of the pressing arms 107 are formed extending forward beyond the cutters 3. The leadscrews 90 continue to rotate in forward direction until the pressing arms 107 reach such a position where the forward ends of the horizontal pressing members 108 are positioned beyond the leading end of the wood board 62, as shown in FIG. 16. The leadscrews 10 continue to rotate in forward direction until the cutter assembly 1 reach the position indicated by dotted line in FIG. 16. The cutters 3 are moved between any two adjacent pressing arms 107 without interfering therewith, so that the pressing and the cutting of the wood board 62 are accomplished successfully. Pressing the wood board 62 at the leading end thereof against the support table 80, any warp or bend of the wood board 62 at the leading end thereof is corrected by being straightened.

As a result of the cutting, the end of the wood board 62 is cut by the cutters 3 and a plurality of first V-shaped groove-like bevel cuts 62A is formed at the leading end of the wood board 62 at an interval 2T of about 48 mm as in the case described with reference to the first embodiment. The leading end of the wood board 62 is pressed flat firmly between the pressing members 34 and the support table 80 to be straightened, so that the first bevel cuts 62A are formed with smoothness and with high accuracy. After the first cut, the cutter assembly 1 is kept at the lowered dotted position (FIG. 16).

Figure 17:
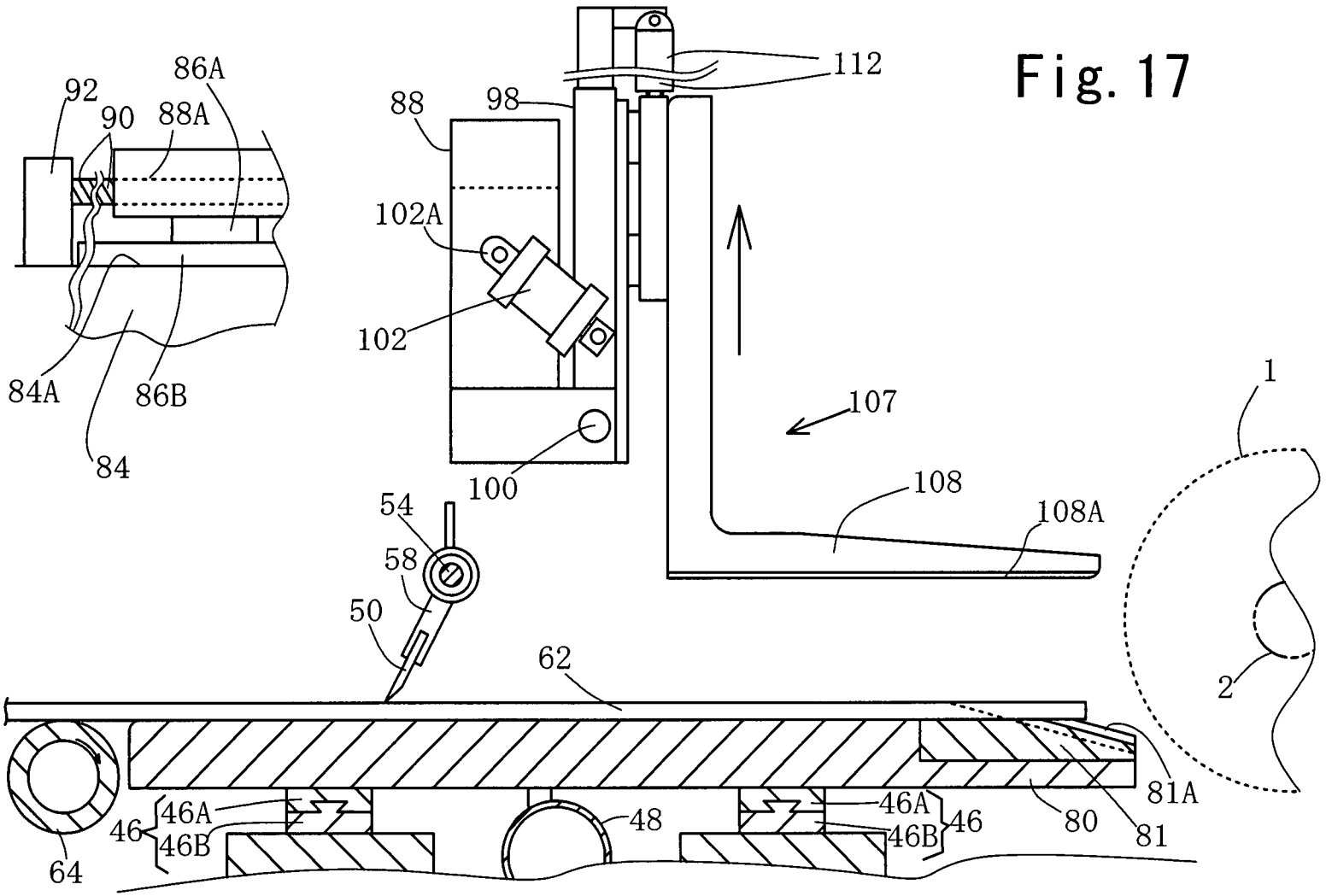

After the first cutting has been completed and the cutter assembly 1 is stopped at the lowered position, the control unit 120 actuates the air cylinders 112 so as to retract their piston rods 112A thereby to move the pressing arms 107 to their elevated position, as shown in FIG. 17. Then, the control units 120 operates the paired air cylinders 102 so as to fully extend their piston rods 102B. As a result, the vertical support member 98 and hence the pressing arms 107 are swung around the shaft 100 to a tilted position, as shown in FIG. 18. The air cylinders 102 and the pressing arms 107 are so configured that the tip ends of the pressing member 108 of the swung pressing arms 107 will not interfere with or hit against the wood board 62. Should any pressing member 108 hit against the wood board 62, the wood board 62 that is held firmly by the hold-down members 50 will not be displaced relative to the support table 80.

When the pressing arms 107 are moved to their elevated position, the air cylinder 48 is operated so as to shift the support table 80 to the second position. This is accomplished by moving the support table 80 for the distance corresponding to the aforementioned width T. As mentioned earlier, the wood board 62 held firmly against the support table 80 by the blade-like hold-down members 50 is shifted integrally with the support table 80 and, therefore, no displacement of the wood board 62 relative to the support table 80 occurs.

Figure 19:
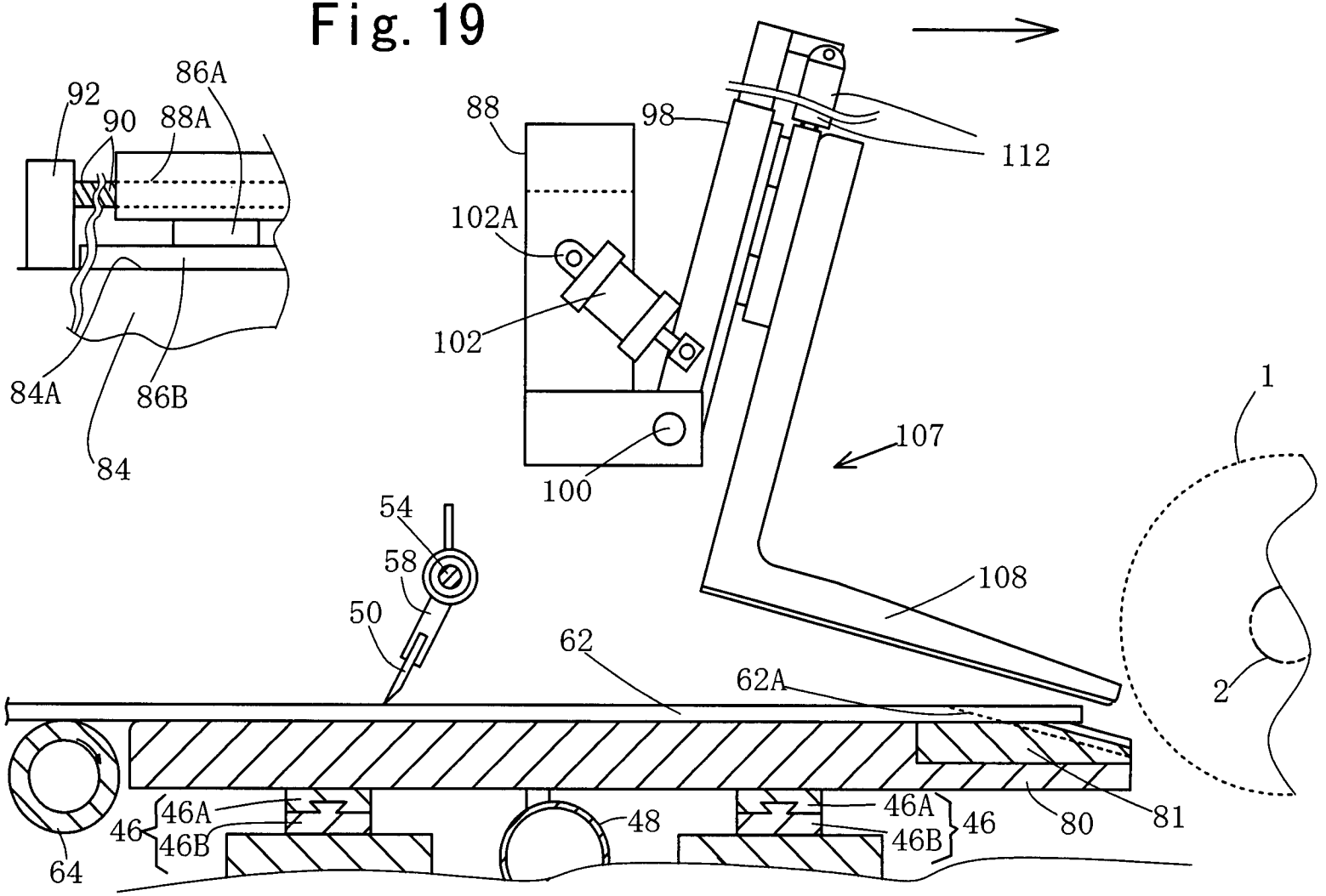
Figure 20:
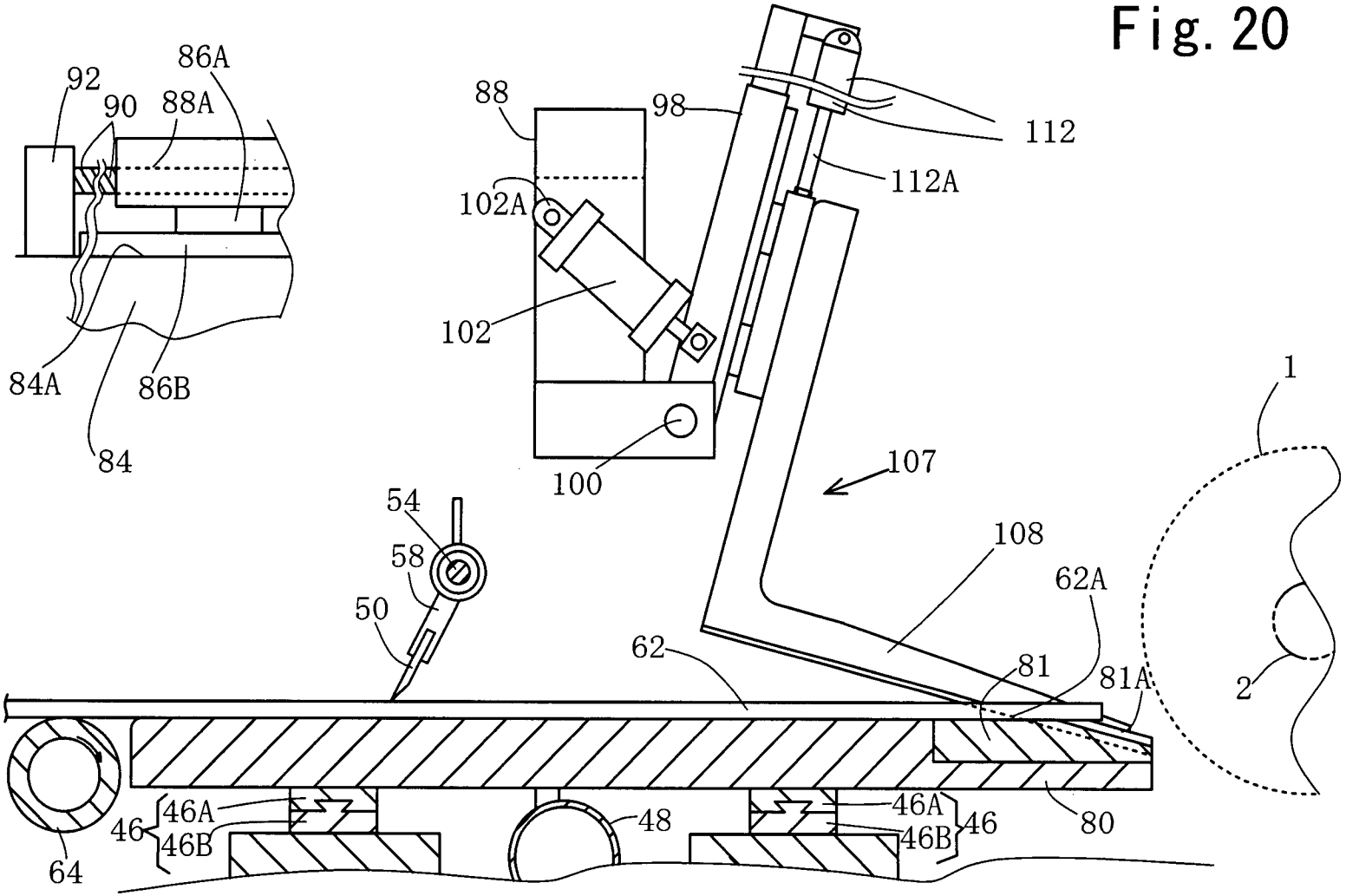

Then, the servomotors 92 are driven to rotate the leadscrews 90 in forward direction thereby to move forward the carriage blocks 88 to a position shown in FIG. 19, where the first bevel cuts 62A are positioned just below the pressing members 108 due to the previous shifting of the support table 42 to its second position. Operating the air cylinders 112 so as to extend the piston rods 112A thereby to lower the pressing arms 107, so that the pressing member 108 press at the beveled surfaces 108B thereof against the wood board 62 at the cut surfaces 62B of the first bevel cuts 62A as shown in FIG. 20, as in the previous case described with reference to FIGS. 10 and 11.

Figure 21:
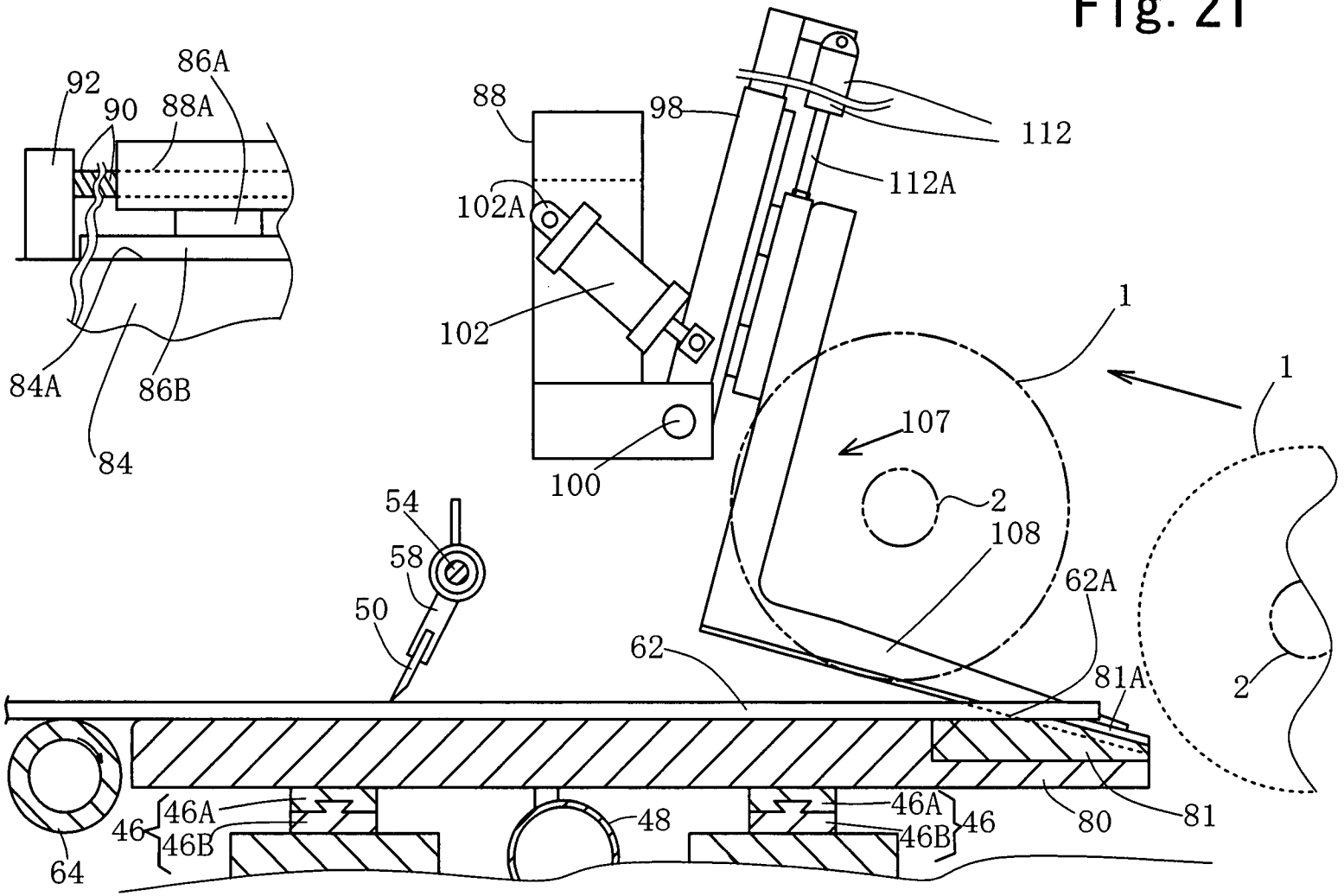

The control unit 120 then activates the paired servomotors 15 to rotate the leadscrews 10 in reverse direction, so that the cutter assembly 1 is moved from the dotted-line position to the retracted position indicated by chain double-dashed line, as shown in FIG. 21, while cutting the leading end of the wood board 62 to form a plurality of second bevel cuts 62C. As a result, a series of V-shaped groove-like bevel cuts 62A and 62C is formed at the leading end of the wood board 62 at an interval T of about 24 mm.

Any two wood boards formed with such bevel cuts are joined together with the opposing bevel cut ends lapped one on the other through any suitable adhesive. Joining is accomplished by setting the adhesive through heating or cooling depending on the type of the adhesive used. The resulting joint having therein no space offers the desired joint strength.

While the present invention has been described so far in the context of specific embodiments thereof, it is to be understood that the invention is not limited to the illustrated embodiments, but it may be practiced in various manners as exemplified below.

In the first and second embodiments, the desired number of bevel cuts 62A and 62C are formed by one cycle of reciprocating motion of the cutter assembly 1. For this purpose, a spacer 4 having the same width as the cutter 3 is interposed between each two adjacent cutters 3. Alternatively, it may be so arranged that, for example, as many as three spacers such as 4 each having the same width as the cutter 3 are interposed between any two adjacent cutters 3. In this case, the desired number of bevel cuts 62A may be formed by two cycles of reciprocating motion of the cutter assembly 1 and shifting movement of the support table 42, 80 for each half of the reciprocating motion of the cutter assembly 1. This method is advantageous in that the cutting resistance acting on the cutting assembly 1 and its related parts or equipment is reduced.

The pressing member 34 (108) has a flat broad surface 34A (108A) and beveled surfaces 34B (108B) for pressing a wood board 62 at the top flat surface and the bevel-cut surfaces 62B thereof, respectively. As long as the pressing of the wood board 62 is accomplished successfully, the shape of the pressing member 34 (108) at the bottom thereof is not limited to that illustrated in the drawings. For example, the pressing member 34 may be replaced with a counterpart pressing member 35 having a rounded bottom 35A, as shown in the insert of FIG. 11. It is noted that the same is true of the pressing members 108 shown in FIG. 14.

In forming the first or second bevel cuts 62A or 62C in the above-described apparatuses, the wood board 62 is pressed against the support table 42, 80 by the pressing members 34 or 108 on opposite or both sides of each cutter 3. In forming a bevel cut at an end of a relatively thin or flexible wood board, however, it may be so arranged that the pressing is done by the pressing member at a position between at least any selected two adjacent cutters 4.

The pressing member 34, 108 of the first and the second embodiments have a flat broad surface 34A, 108A pressingly contactable with the flat top surface of a wood board 62 that is yet to be formed with a bevel cut 62A and two beveled surfaces 34B, 108B pressingly contactable with the cut surfaces 62B of the bevel cut 62A. Alternatively, the member for pressing the top surface and the member pressing the bevel-cut surfaces may be provided independently and operable appropriately so as to press the wood board against the support table.

In the apparatuses for practicing the method of the first and the second embodiments, the cutter assembly 1 is moved reciprocally by using a pair of leadscrews 10 each driven by its own servomotor 15. It may be so arranged, however, that apparatus may use only one servomotor 15 for reciprocally moving the cutter assembly 1. As will be apparent to those skilled in the art, this may be accomplished by providing a bevel gear at the lower end of each leadscrew 10 and an intermediate shaft having at the opposite ends thereof bevel gears that are engaged the respective bevel gears on the leadscrews 10. By so arranging, the rotation of one leadscrew 10 driven by the servomotor 15 is transmitted to the other leadscrew 10 through the bevel gears and the intermediate shaft ant the two leadscrews 10 can be rotated synchronously, with the result that the drive shaft 2 on which the cutters 3 are mounted is moved accurately while maintaining its perpendicular relation to the direction in which the cutter assembly 1 is moved and, therefore, the bevel cuts 62A, 62C can be formed with high accuracy.

In the apparatuses for practicing the method of the first and second embodiments, the cutter assembly 1 is moved obliquely downward from the upper position indicated by chain double-dashed to the lowered position indicated by dotted line shown for example in FIG. 16 in forming the first bevel cuts 62A and moved obliquely upward in the reverse direction, as shown in FIG. 21, in forming the second bevel cuts 62C. The bevel cuts 62A and 62C may be formed differently. Specifically, the first bevel cuts 62A may be formed by the upward movement of the cutter assembly 1, while the second bevel cuts 62C may be formed by the downward movement of the cutter assembly 1.

As indicated earlier, the term of wood member as used herein refers to various kinds of board, panel, plate and sheet such as plywood, veneer laminated lumber (LVL), sawn lumber, fiber board, veneer sheet, etc. Additionally, the wood member need not necessarily be of a rectangular shape, but it may be of other shapes such as parallelogram.

What is claimed is:

1. A method for forming bevel cuts at an end of a wood member, comprising steps of:

(a) placing a wood member having a straight end extending perpendicular to an infeed direction thereof on a support table, said support table having cutouts therein at an end thereof, the straight end of said wood member being located adjacent to the end of the support table;

(b) pressing the wood member against the support table by pressing members at a position adjacent to the straight end of the wood member;

(c) moving at least one of the support table and a plurality of cutters relative to each other in a perpendicular direction to the straight end of said wood member placed on the support table, said plurality of cutters being rotatable about a common axis of rotation extending parallel to the straight end of the wood member placed on the support table and each having a cutting width L1 as measured along the common axis, said cutters being spaced along the common axis with a spaced distance mL1 between any two adjacent cutters, where m represents an integer that is one or more, said step (c) occurring in an inclined direction with respect to opposite surfaces of the wood member placed on the support table, thereby allowing said cutters to perform a first cutting step to form an inclined end of the wood member at the straight end of the wood member, said first cutting step being performed with the wood member pressed against the support table by the pressing members at a position between at least any selected two adjacent cutters, said cutouts in the support table being inclined substantially in the same direction as a direction in which the cutters are allowed to move past the support table so that no interference occurs between the cutters and the support table during said movement;

(d) releasing the pressing of the wood member by the pressing member; and (e) shifting at least one of the support table and the cutters to a shifted position relative to each other in a direction along said common axis of the cutters for a distance of nL1, where n represents an integer that is one or more;

(f) moving at least one of the support table and the cutters relative to each other at said shifted position along said inclined end of the wood member formed after the first cutting step thereby allowing said cutters to perform a second cutting step at the straight end of the wood member;

said second cutting step being performed at least once after the first cutting step, whereby a series of continuous bevel cuts each extending from one surface of the wood member facing towards the cutters to the opposite surface of the wood member are formed at the straight end of the wood member at an interval of L1, said series of continuous bevel cuts each having a width of L1 along the straight end of the wood member, and two continuous surfaces inclined and forming a V-shape at any section across the bevel cuts at the straight end of the wood member at an interval of L1.

2. A method for forming a bevel cut at an end of a wood member, comprising steps of:

(a) placing a wood member having a straight end extending perpendicular to an infeed direction thereof on a support table, said support table having cutouts therein at an end thereof, the straight end of said wood member being located adjacent to the end of the support table;

(b) moving at least one of the support table and a plurality of cutters relative to each other in a perpendicular direction to the straight end of said wood member placed on the support table, said plurality of cutters being rotatable about a common axis of rotation extending parallel to the straight end of the wood member placed on the support table and each having a cutting width L1 as measured along the common axis, said cutters being spaced along the common axis with a spaced distance mL1 between any two adjacent cutters, where m represents an integer that is one or more, said step (b) occurring in an inclined direction with respect to opposite surfaces of the wood member placed on the support table, thereby allowing said cutters to perform a first cutting step to form an inclined end of the wood member at the straight end thereof, said cutouts in the support table being inclined substantially in the same direction as a direction in which the cutters are allowed to move past the support table so that no interference occurs between the cutters and the support table during said movement;

(c) shifting at least one of the support table and the cutters to a shifted position relative to each other in a direction along said common axis of the cutters for a distance of nL1, where n represents an integer that is one or more;

(d) pressing the wood member against the support table by pressing members by pressing cut surfaces formed by the first cutting step;

(e) moving at least one of the support table and the cutters relative to each other in the shifted position of at least one of the support table and the cutters in a perpendicular direction to the straight end of said wood member placed on the support table, thereby to allow said cutters to perform a second cutting step to form an inclined end of the wood member at the straight end of the wood member, said second cutting step being performed with the wood member pressed against the support table by the pressing members at a position between at least any selected two adjacent cutters;

said second cutting step being performed at least once after the first cutting step, whereby a series of continuous bevel cuts each extending from one surface of the wood member facing towards the cutters to the opposite surface of the wood member are formed at the straight end of the wood member at an interval of L1 along the straight end of the wood member, and two continuous surfaces inclined and forming a V-shape at any section across the bevel cuts at the straight end of the wood member at an interval of L1.

3. A method for forming a bevel cut at an end of a wood member, comprising steps of:

(a) placing a wood member having a straight end extending perpendicular to an infeed direction thereof on a support table, said support table having cutouts therein at an end thereof, the straight end of said wood member being located adjacent to the end of the support table;

(b) pressing the wood member against the support table by pressing members at a position adjacent to the straight end of the wood member;

(c) moving at least one of the support table and a plurality of cutters relative to each other in a perpendicular direction to the straight end of said wood member placed on the support table, said plurality of cutters being rotatable about a common axis of rotation extending parallel to the straight end of the wood member placed on the support table and each having a cutting width L1 as measured along the common axis, said cutters being spaced along the common axis with a spaced distance mL1 between any two adjacent cutters, where m represents an integer that is one or more, said step (c) occurring in an inclined direction with respect to opposite surfaces of the wood member placed on the support table, thereby allowing said cutters to perform a first cutting step to form an inclined end of the wood member at the straight end of the wood member, said first cutting step being performed with the wood member pressed against the support table by the pressing members at a position between at least any selected two adjacent cutters, said cutouts in the support table being inclined substantially in the same direction as a direction in which the cutters are allowed to move past the support table so that no interference occurs between the cutters and the support table during said movement;

(d) releasing the pressing of the wood member by the pressing member;

(e) shifting at least one of the support table and the cutters to a shifted position relative to each other in a direction along said common axis of the cutters for a distance of nL1, where n represents an integer that is one or more;

(f) pressing the wood member against the support table by the pressing members by pressing cut surfaces formed by the first cutting step; and (g) moving at least one of the support table and the cutters relative to each other at the said shifted position along said inclined end of the wood member made after the first cutting step thereby allowing said cutters to perform a second cutting step at the straight end of the wood member, said second cutting step being performed with the wood member pressed against the support table by the pressing members at a position between at least any selected two adjacent cutters;

said second cutting step being performed at least once after the first cutting step, whereby a series of continuous bevel cuts each extending from one surface of the wood member facing towards the cutters to the opposite surface of the wood member are formed at the straight end of the wood member at an interval of L1, said series of continuous bevel cuts each having a width of L1 along the straight end of the wood member, and two continuous surfaces inclined and forming a V-shape at any section across the bevel cuts at the straight end of the wood member at an interval of L1.

4. A method according to claim 3, wherein said pressing member has: a first surface that is contactable with a flat surface of the wood member during the first cutting; and a second surface that is contactable during the second cutting with said cut surfaces formed by the first cutting.

* * * * *